US005323586A

United States Patent [19]

Lissoni et al.

[11] Patent Number: 5,323,586

[45] Date of Patent: Jun. 28, 1994

[54] BOX CLOSING AND TAPING MACHINE

[75] Inventors: Adelio Lissoni, Vedano Olona, Italy; Lloyd S. Vasilakes, St. Paul, Minn.; Richard H. Schmidt, Woodbury, Minn.

[73] Assignee: Minnesota Mining and Manufacturing Company, St. Paul, Minn.

[21] Appl. No.: 808,107

[22] Filed: Dec. 16, 1991

[51] Int. Cl.[5] ..... B65B 57/04

[52] U.S. Cl. ..... 53/136.4; 53/76; 53/377.2; 53/378.3; 156/351; 156/468

[58] Field of Search ..... 53/76, 136.4, 377.2, 53/378.3; 156/351, 468, 475, 486; 493/177, 178, 475, 476, 477, 478, 479

[56] References Cited

U.S. PATENT DOCUMENTS

| | | | |
|---|---|---|---|
| 3,045,402 | 7/1962 | Keely et al. | 53/66 |
| 3,228,172 | 1/1966 | Johnson et al. | 53/377.2 |
| 3,748,812 | 7/1973 | Burn | 53/66 |
| 3,769,777 | 11/1973 | Miller et al. | 53/76 |
| 3,775,937 | 12/1973 | Devan et al. | 53/75 |
| 3,905,175 | 9/1975 | Marchetti | 53/76 |
| 3,915,786 | 10/1975 | Collett et al. | 156/355 |
| 3,954,550 | 5/1976 | Patterson | 156/486 |
| 3,990,933 | 11/1976 | Verch | 156/250 |
| 4,028,865 | 6/1977 | Loveland et al. | 53/76 |
| 4,218,862 | 8/1980 | Marchetti | 53/377.2 |
| 4,238,269 | 12/1980 | Deering, Jr. | 156/465 |
| 4,262,468 | 4/1981 | Marchetti | 53/377.2 |
| 4,541,888 | 9/1985 | Marchetti | 156/468 |
| 4,545,176 | 10/1985 | Marchetti | 53/76 |
| 4,548,022 | 10/1985 | Yaklin | 53/415 |
| 4,585,504 | 4/1986 | Marchetti | 156/351 |
| 4,633,642 | 1/1987 | Lissoni . | |
| 4,640,731 | 2/1987 | Lerner et al. | 156/355 |
| 4,642,966 | 2/1987 | Marchetti | 53/377.2 |
| 4,643,707 | 2/1987 | Marchetti | 493/117 |
| 4,653,247 | 3/1987 | Marchetti . | |
| 4,658,563 | 4/1987 | Lissoni | 53/136.4 |
| 4,748,794 | 6/1988 | Marchetti . | |
| 4,846,921 | 7/1989 | Lerner et al. | 53/136.4 X |

FOREIGN PATENT DOCUMENTS

| | | |
|---|---|---|
| 0177003A1 | 4/1986 | European Pat. Off. . |
| 2190089 | 1/1974 | France . |
| 1228496 | 4/1971 | United Kingdom . |
| 1585335 | 2/1981 | United Kingdom . |

OTHER PUBLICATIONS

Brochure Entitled "3M-Matic 12AF Automatic Adjustable Case Sealer".

Brochure from Durable Packaging Corp. "RM-3, RM3-FC & RM3-FCS Uniform Case Sealers".

Brochure from Loveshaw "Little David", 1991.

Brochure from Comarme "GEM F 50".

Brochure Entitled "3M-Matic 77R Random Case Sealer".

Brochure Entitled "3M-Matic 22A Adjustable Case Sealer".

Brochure Entitled "3M-Matic 77A Adjustable Case Sealer".

*Primary Examiner*—John Sipos

*Assistant Examiner*—Daniel Moon

*Attorney, Agent, or Firm*—Gary L. Griswold; Walter N. Kirn; Mark W. Binder

[57] ABSTRACT

The present invention is directed to a machine for closing and sealing an article, such as a box or carton, as it is driven through the machine. Specifically, upper and lower taping heads are provided for applying lengths of tape to the bottoms and tops of the boxes. The upper box flaps are also preferably folded by the machine of the present invention by a folding mechanism including a ski for folding the leading minor flap, a kicker for folding the trailing minor flap, and shaped rods for folding the major side flaps after the minor flaps are folded. In accordance with the present invention, the upper head assembly is advantageously adjustably connected to the machine so that proper leveling of the upper taping head and the folding mechanism can be assured. Moreover, such adjustment can be redone at any time thereafter as needed as affected by working conditions over time. Additionally, the subject machine includes a control system which uses only a minimum number of control sensors, namely two control valves, to control both the kicker and a gating mechanism effectively while permitting easy operator adjustment and machine versatility.

32 Claims, 16 Drawing Sheets

BOX CLOSING AND TAPING MACHINE

TECHNICAL FIELD

The present invention relates to machines for sealing boxes or cartons by applying lengths of tape, such as pressure-sensitive adhesive tape to such boxes or cartons. Moreover, the present invention relates to the closing of such boxes or cartons before taping and the manner of timing and controlling the folding and taping operations for each box or carton that is driven through the machine.

BACKGROUND OF THE INVENTION

Box sealing machines including upper and lower taping heads for applying lengths of pressure-sensitive adhesive tape to a box or carton driven through the machine are generally well known. Moreover, the provision of means for folding the box flaps so as to close such a box in combination with the taping heads of box sealing machines is also well known. Such means for folding the top box flaps typically include a ski which is supported from an upper cross member assembly so as to engage and fold a leading minor flap of a box, major side flap folding guides or rods which engage the major side flaps as the box moves forwardly so as to urge them downwardly to their closed position, and a trailing minor flap folding assembly which folds the trailing minor flap prior to the closing of the major side flaps. After the folding is completed, an upper taping head seals the top of the box by a length of tape applied to the upper major side flaps. Normally, at the same time a lower taping head applies a length of tape to the lower major side flaps.

The trailing minor flap folding assembly is known to comprise what is hereinafter referred to as a kicker which is pivotally supported from the upper cross member assembly and which is driven by a means, such as a pneumatic cylinder, to engage with and to fold the trailing minor flap before the major side flaps are folded by the major flap folding guides or rods. In order to accomplish this, the kicker must be timed with respect to the position of the box along the machine and the major flap folding guides or rods. Typically, a means which senses the relative position of a box for actuating the kicker drive means is used. Such means may detect either the front edge or the rear edge of the box. Known sensing means include the use of photocells, limit switches, and levers which are actuated by engagement with or disengagement from either the box front edge or rear edge. Furthermore, the kicker must be repositioned in its raised position after the box has passed through at least the folding portion of the machine in preparation for the next box to be driven through the machine. This reposition may occur as a result of the box moving from and deactivating such a limit switch or photocell, or by activating yet another such sensor provided farther downstream. The addition of more sensors disadvanteously increases the complexity of the machine control system; however, the use of the same sensor to control raising and lowering has heretofore been inadequate in that the machine lacks versatility.

In order to control feeding of subsequent boxes into the box sealing machine, it is further known to provide a mechanism for preventing entry of the next box into the box sealing machine until after a first box is sufficiently driven through the box sealing machine and the folding mechanism is reconfigured back to its ready position for receiving the next box. Such a mechanism is known to include devices which block entry of subsequent boxes into the box sealing machine that engage with the next box and which permits passage at an appropriate time. One known device comprises a gate pivotally mounted to the machine bed which is movable between a blocking position above the plane of the bed and an open position below the plane of the bed. Such gates can be conventionally movable between the blocking and open positions by a pneumatic cylinder, and can be controlled in a similar manner as the kicker assembly, discussed above, by the provision of sensors, such as photocells, limit switches, or levers, to permit passage of the next box into the machine only after the previous box passes a certain point along the machine. Moreover, in order to initiate both the blocking and open gate positions, either a plurality of sensors are required, one for defining each position, or the gate positions must be determined by the actuation or not of a single sensor. Since it is important that the gating device be timed with respect to the other operations of the box sealing machine, including any kicker mechanism or other flap folding device, it is difficult to control the necessary machine configurations without a multiplicity of sensors for each such operational mechanism while permitting versatility to adjust the machine to provide optimum setting for a particular box. The use of so many sensors greatly increase the complexity of the control system, such as a pneumatic circuit, for such a box sealing machine. In particular, each sensor is typically associated with a valve of a pneumatic circuit thus rendering the pneumatic circuit more complex and costly. Any compromise as to the number of sensors needed results in a less efficient and less versatile machine due to problems in coordinating the related activities of the machine or by slowing down the number of boxes which can pass through the machine for a given time period.

Another problem common to prior art box sealing machines involves the provision of the upper taping head and any upper box flap folding mechanisms, such as a ski and/or kicker, supported from an upper cross member. Typically, such an upper cross member is vertically adjustably supported from the machine base so as to position the upper taping head and any box flap folding mechanisms at the appropriate level for a specific box driven through the machine. Such adjustment may be automatic or manual. The problem is that it is difficult to ensure that the upper taping head and/or the box flap folding mechanism are properly level to adequately perform their related functions. Moreover, such problem is worsened over time and usage of the machine. The taping head and box folding mechanism are typically rigidly cantilever mounted to the upper cross member. Thus, it is imperative that at original construction, the upper taping head and box flap folding mechanism be accurately aligned and connected to the upper cross member. Moreover, the pressures exerted on such connection during usage of the machine over time may tend to cause slight deformation at the connection, thereby unleveling the upper taping head, the box flap folding mechanism, or both.

Examples of box sealing machines including upper taping heads supported by an upper cross member are described in: U.S. Pat. No. 4,633,642 to Lissoni, U.S. Pat. No. 4,238,269 to Deering, Jr., U.S. Pat. No. 4,028,865 to Loveland et al, and U.S. Pat. Nos.

4,748,794, 4,653,247, 4,643,707, 4,585,504, and 4,541,888 and the British Patent Specification No. 1,585,335 to Marchetti.

SUMMARY OF THE INVENTION

In general, the present invention comprises a box sealing machine which overcomes the shortcomings of prior art box sealing machines. In one aspect, the present invention includes an improved upper head mounting mechanism which ensures proper alignment of the upper taping head and any box flap folding mechanism, if so provided, which may be adjusted at set up of the machine or at any time thereafter. In another aspect, the machine of the present invention includes a control system for operating a box flap folding mechanism and a gating mechanism which requires a minimum of box position sensors while maximizing the rate at which boxes of various sizes can be driven through the machine. Moreover, the maximum box length can be greater for a given machine since the front edge of each box controls the machine operations. As a result, the control system is optimized for simplicity, versatility and allows for easy operator adjustments.

The above advantages are achieved in accordance with one aspect of the present invention by an apparatus for applying tape to an article, such as a box or carton, including a base having a surface over which the article can be conveyed which is supported in position. An upper taping head assembly is provided including an upper taping head for applying tape to the article as the article is conveyed past the upper taping head in the longitudinal direction of the apparatus. An upper taping head support means is also provided for supporting the upper taping head assembly in a position over said surface, and the upper taping head support means comprising an upper cross beam operatively supported with respect to said base. The upper cross beam is adjustably connected with the upper taping head assembly so that the upper taping head assembly can be angularly adjusted about an axis transverse of the apparatus. Preferably, the upper taping head support means further comprises a vertically adjustable strut mechanism for vertically locating the upper taping head assembly.

Moreover, the upper taping head assemble further comprises a lower cross beam which is pivotally connected to the strut mechanism about the transverse axis and to which the upper taping head is connected. Preferably, the upper taping head assembly also includes a box flap folding means for folding at least one upper flap of a box as the box is conveyed through said apparatus. Such a box flap folding means can include a ski, a kicker, or both. The ski and/or kicker would also be adjustable with the upper taping head. More particularly, the upper taping head assembly is also adjustably connected to the upper cross beam by a support member thereof. Such adjustable connection preferably comprises a plate portion of the upper cross beam and a plate portion of the support member which are adjustably connected together by an expandable means for permitting increasing and decreasing of the distance between the plate portions of the upper cross beam and the support member. Thereby, the lower cross beam can be rotated about its pivotal axis.

In another aspect of the present invention, an apparatus for conveying and closing a box is provided. Such apparatus is made up of a base including a surface over which the article can be conveyed which is supported in position, a box flap folding means comprising a kicker which is pivotally mounted to a support member and a drive means for selectively moving said kicker between plural angular positions, upper support means for supporting said support member and said kicker in a position over said surface so that a flap of a box moved in one direction along said surface of said base can be folded by said kicker, conveying means for moving a box along the surface in the one direction from an infeed end to an exit end of the apparatus, a gating mechanism for selectively blocking or allowing a box to enter the infeed end of the apparatus, and a control means for selectively controlling the drive means of the kicker and the gating mechanism. The control means preferably comprises a first cam mechanism and a second cam mechanism with a leading edge of the first cam mechanism located closer in the one direction to the infeed end than the leading edge of the second cam mechanism. The first and second cam mechanisms are independently movable between raised positions where portions thereof are above the surface of the base and lower positions where they lie below the surface of the base, and the first and second mechanisms are biased to their raised positions so that they will be forced toward their lower positions by engagement thereof with a box being conveyed through the apparatus. The control means further controls the kicker and the gating mechanism by the actions of the first and second cam mechanisms, wherein when both cam mechanisms are in their raised positions, the kicker is in a raised position permitting a box to travel thereunder and the gating mechanism is in its passing position also permitting a box to travel thereover.

When the first cam mechanism is depressed to its lower position by a box, the gating mechanism is moved to its blocking position for preventing the infeed of another box. When the second cam mechanism is depressed to its lower position by the box while the first cam mechanism is maintained depressed, the kicker is activated to move to a lower position for folding an upper flap of the box conveyed through the apparatus. Preferably, the gating mechanism comprises a gate movably mounted to the base and a second drive means for moving the gate between blocking and passing positions. Moreover, the first cam mechanism is of a sufficient length in the direction of travel of the box through the apparatus so that release of the first cam mechanism occurs after the second cam mechanism is depressed, and the release of the first cam mechanism causes the drive means of the kicker to move the kicker to its raised position and the second drive means to lower the gate to its passing position. The second cam mechanism is also preferably adjustably mounted to the base to be selectively positionable within a range along the direction of travel of the box through the apparatus. Furthermore, the control means preferably comprises a pneumatic circuit, and the first and second cam mechanisms each include a control valve actuable between plural positions depending on whether the cam mechanisms are raised or lowered, and the drive means for the kicker and the second drive means for the gate comprise pneumatic cylinders.

BRIEF DESCRIPTION OF THE DRAWINGS

FIG. 11A shows the initial circuit of the machine with both cam mechanisms at rest.

DETAILED DESCRIPTION OF THE PREFERRED EMBODIMENT

Figure 1:
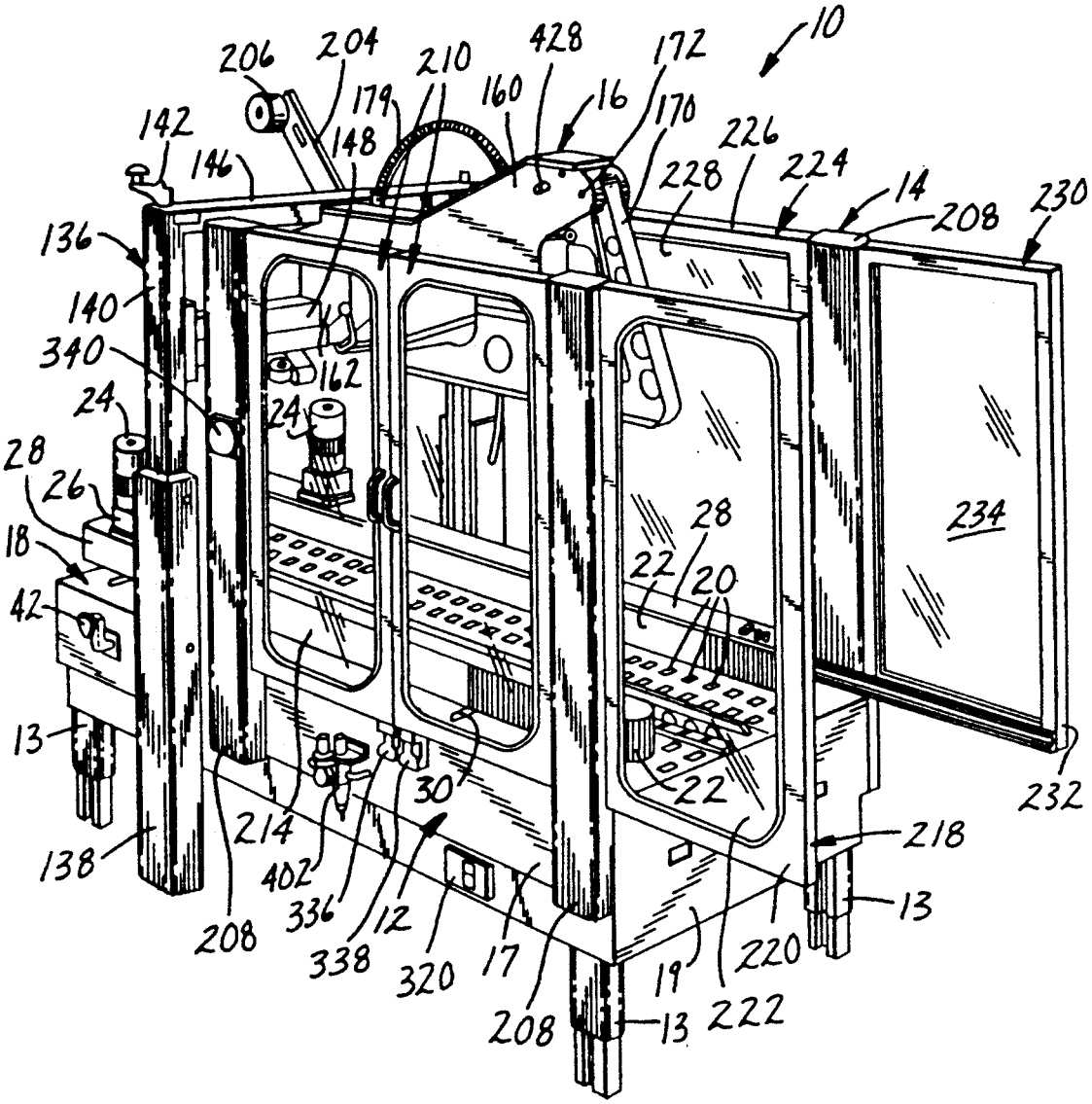
FIG. 1 is a perspective view of a box closing and sealing machine in accordance with the present invention.
Figure 2:
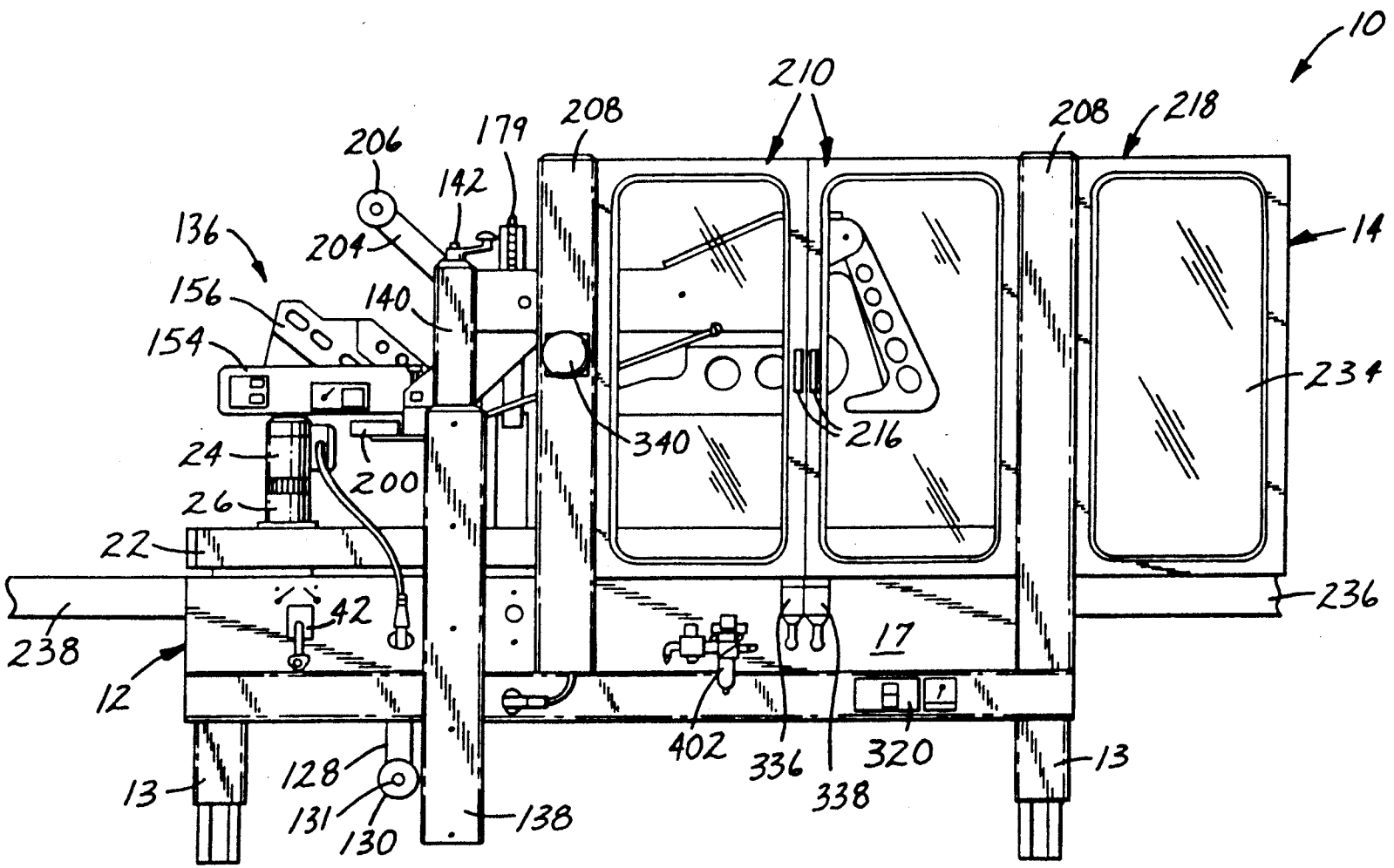
FIG. 2 is a side view of the box closing and sealing machine of FIG. 1.

With reference to the drawings, wherein like numerals are used to designate like components throughout the several figures, and initially to FIGS. 1 and 2, a box closing and sealing machine 10 is illustrated which generally comprises a base 12, a protective door assembly 14, and an upper taping head assembly 16.

At a top surface 18 of base 12, a bed of freely rotatable rollers 20 are conventionally supported so that an article such as a box or carton placed on the bed of rollers 20 is freely movable in the longitudinal direction of the box closing and sealing machine 10. The base 12 includes legs 13 which are conventionally adjustable for positioning and maintaining the top surface 18 of base 12 at a substantially level condition. In order to drive such boxes or cartons through the box closing and sealing machine 10, a pair of side drive belts 22 are provided which are each independently driven by electric motors 24 including gear reduction mechanisms 26 which are conventionally mounted to top frame members 28 of each side drive belt 22.

The side drive belts 22 are driven by the electric motors 24 in a well known manner. Moreover, each of these side drive belts 22 are adjustable along the plane of the top surface 18 of base 12. Such adjustment is facilitated by arcuate slots 30 through the top surface 18 and a lever arrangement, best seen in FIG. 13 which comprises levers 32 including pins 33 (see FIG. 9) extending through the slots 30 for pivotally supporting the side drive belts 22. The levers 32 are further mounted to the base at pivot pins 34 which are spaced from pins 33. On each side of the box closing and sealing machine 10, the levers 32 are connected by connecting rods 36 which assure movement of the levers 32 on each side with one another. In order to connect both sides of the lever mechanisms together, a transfer mechanism such as a chain 38 is used for connecting opposed levers 32 across the machine 10 by way of a pair of sprockets 40. An adjustment crank 42 is provided on a side wall 17 of base 12 and includes a threaded rod 44 which turns with the crank 42 and both of which are axially fixed. The threaded rod 44 engages with a nut 46 pivotally mounted on one of the levers 32. Thus, as the crank 42 is rotated, adjustment is made to the one lever 32 and the remaining three other levers 32 follow with the same movement as connected above. Accordingly, side drive belts 22 are adjustable according to the width of the article such as a box or carton driven through the box closing and sealing machine 10.

Figure 13:
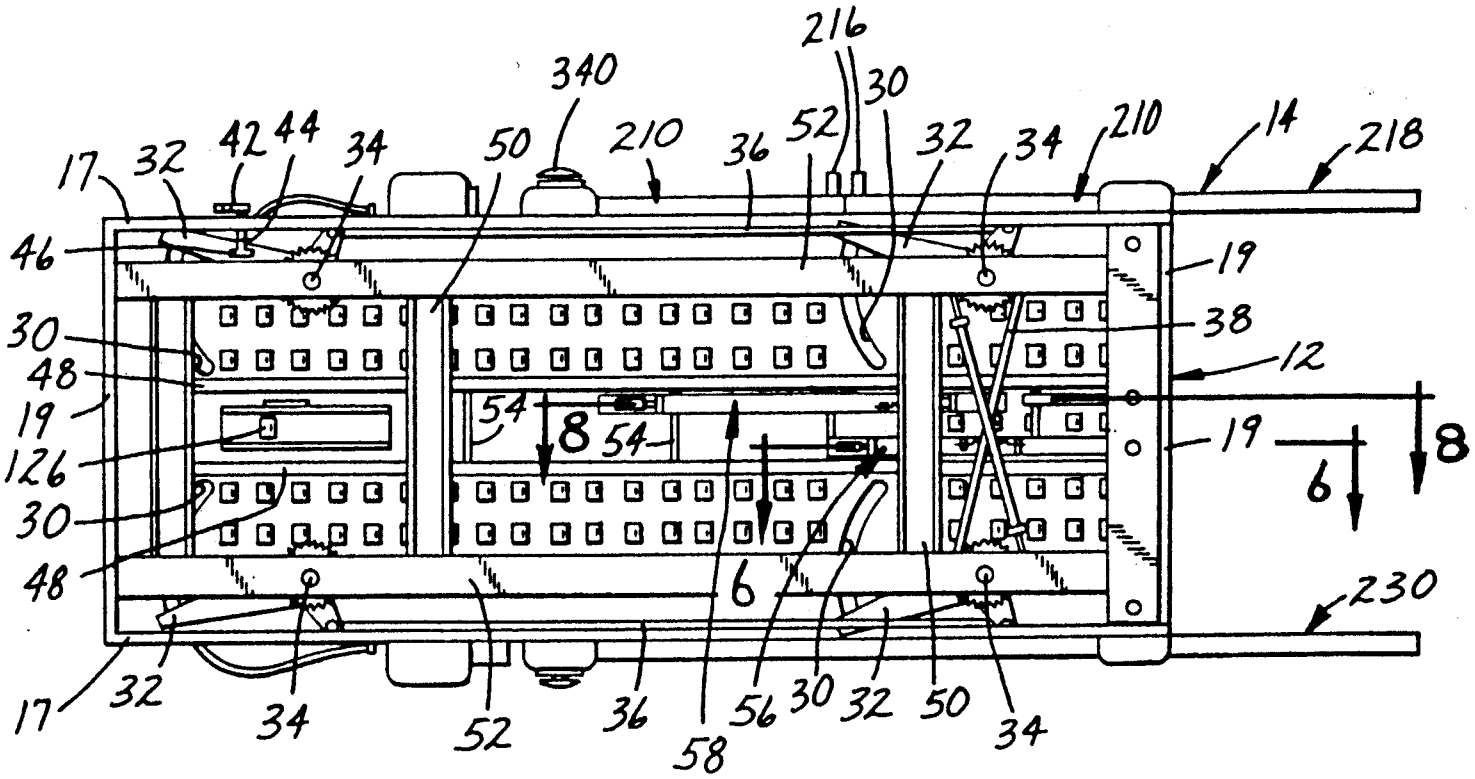
FIG. 13 is a bottom view of the box closing and sealing machine of FIG. 1.

As also seen in FIG. 13, a pair of spaced central frame members 48 are provided which are supported in position to the base 12 by transverse frame members 50 and further longitudinal members 52 which are connected to end walls 19 of the base 12. The central frame members 48 are spaced from one another and connected to one another by a plurality of spacer elements 54. Note also that the pivot pins 34 for each lever 32 is pivotally fixed in position to the longitudinal frame members 52 and thus the base 12.

Figure 6:
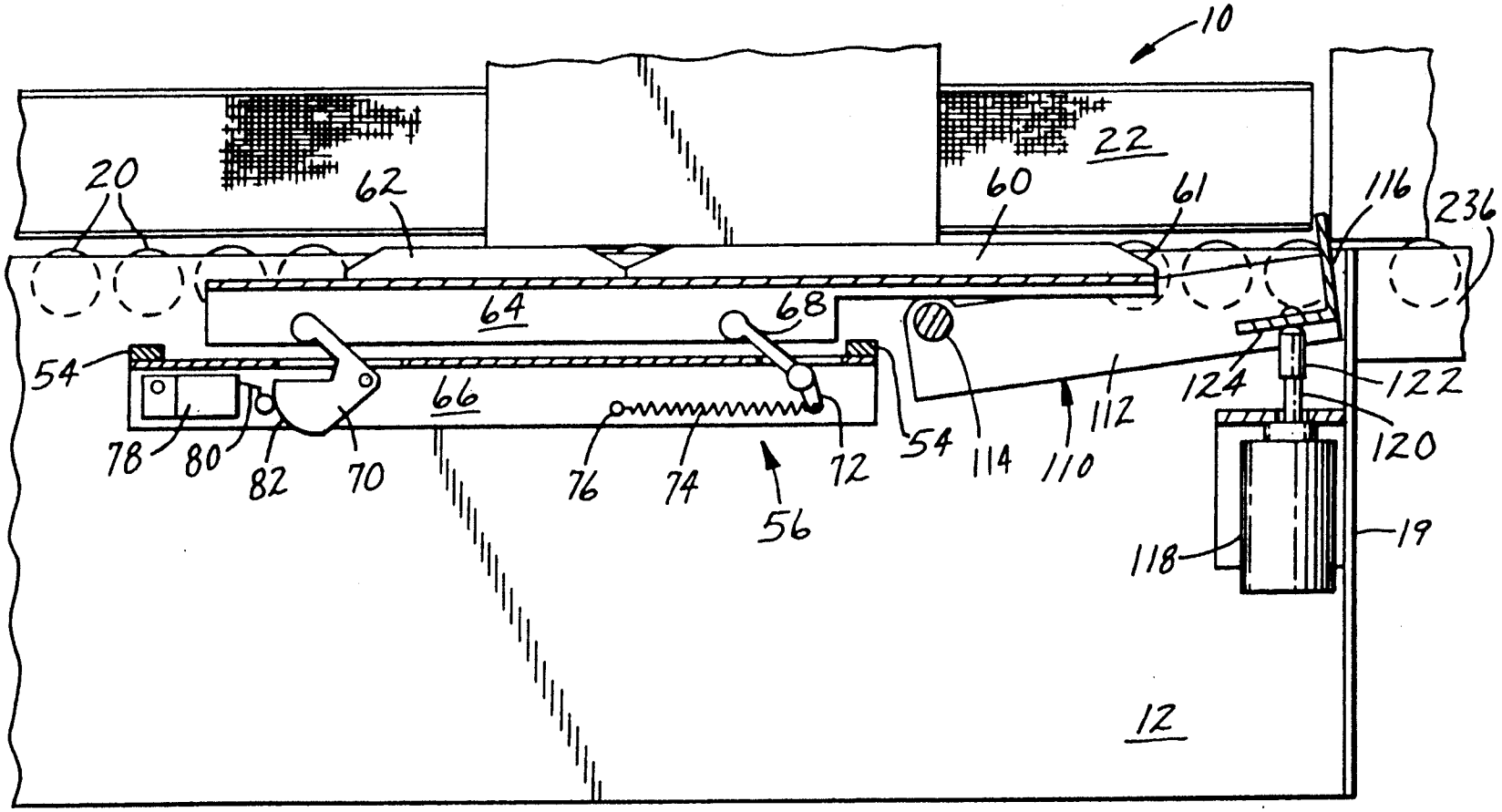
FIG. 6 is a longitudinal cross-sectional view taken along line 6—6 in FIG. 13 actuation of a first cam mechanism while the gate of the gating mechanism is in its upper position extending above the plane of the bed.

Mounted between the pair of central frame members 48 are first and second cam mechanisms 56 and 58, respectively. Referring now to FIG. 6, the first cam mechanism 56 is made up of cam portions 60 and 62 which are arranged in line with one another and which are together fixed with a horizontal moving bar 64 which is further part of a four-bar linkage that also includes stationary bar 66 and first and second swing links 68 and 70, respectively. The first and second swing links 68 and 70 are pivotally connected to both the moving bar 64 and the stationary bar 66 in a conventional four-bar linkage arrangement and are preferably substantially parallel to one another so that the moving bar 64 is maintained generally parallel to the stationary bar 66 during movement. A lower end 72 of the first swing link 68 is connected with a biasing means such as tension spring 74 which is further connected to the stationary bar 66 at point 76. The tension spring 74 urges both the first and second swing links 68 and 70 respectively, as seen in FIG. 6, clockwise.

Figure 7:
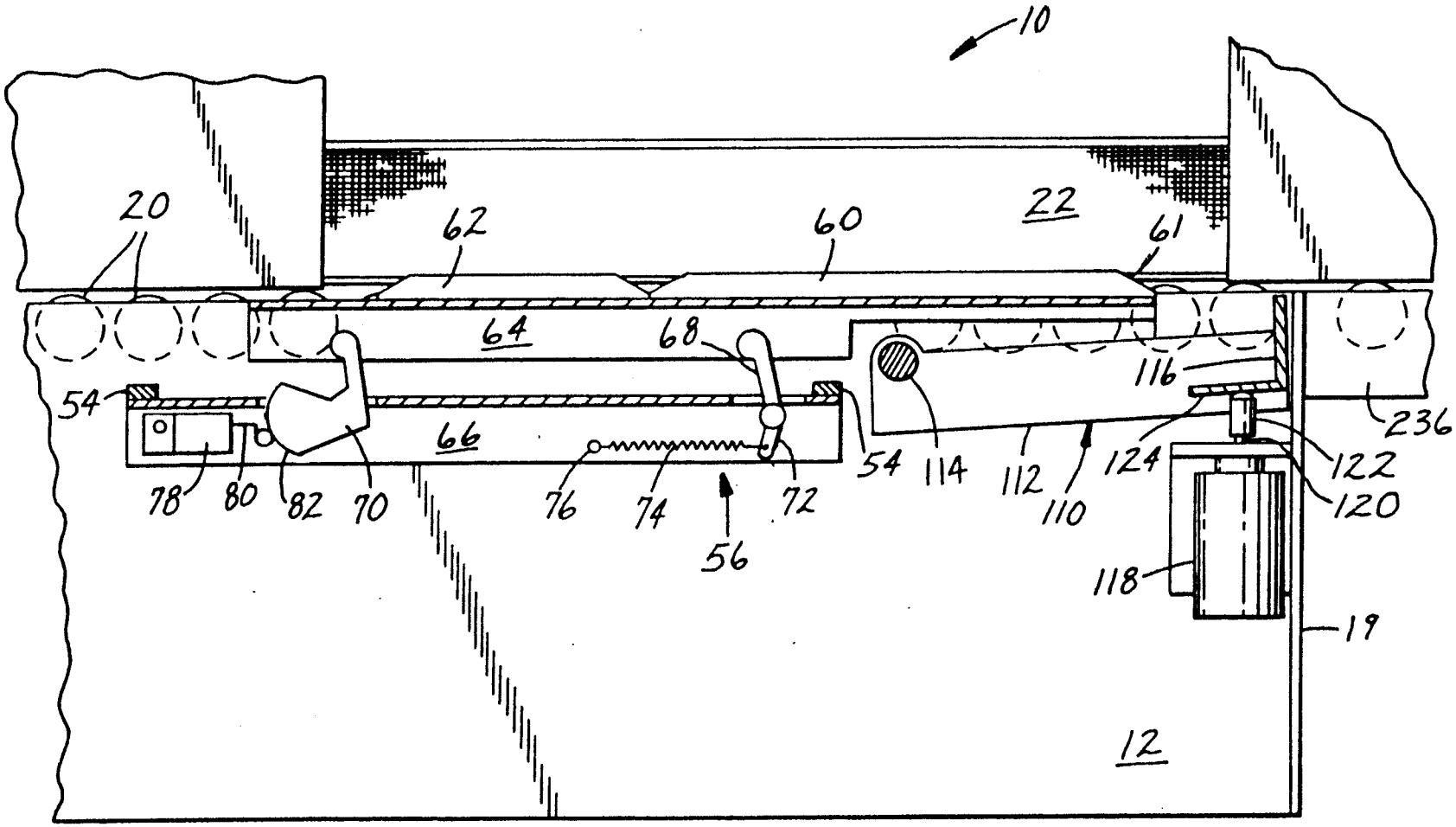
FIG. 7 is a view similar to FIG. 6 but illustrating the first cam mechanism in its biased raised position and with the gate of the gating mechanism down.

As shown in FIG. 7, such biasing urges the first and second cam portions 60 and 62 upward to extend partially above the plane of the bed of rollers 20. In the FIG. 6 position, a box is shown holding the cam portions 60 and 62 below the plane of the bed of rollers 20 which forces the moving bar 64 downwardly against the bias of tension spring 74. The first cam mechanism 56 further includes a three-way two position valve 78 which is mounted to the stationary bar 66 and which includes a positioning element 80 which rides against a caming surface 82 of the second swing link 70. As shown in FIG. 6, when the moving bar 64 is forced downwardly, such as by a box or carton, the camming surface 82 pushes the positioning element 80 into the three-way two position valve 78 to a first position thereof. When the moving bar 64 is moved upwardly under the bias of spring 74, as shown in FIG. 7, the camming surface 82 allows the positioning element 80 to move outwardly from the three-way two position valve 78 thus defining the second position thereof. The positioning element 80 is also influenced by a biasing means within the three-way two position valve 78 which urges the positioning element 80 toward the outward second position. The stationary bar 66 of the first cam mechanism 56 is preferably supported and positioned to the central members 48 by connection to the spacer elements 54.

Figure 8:
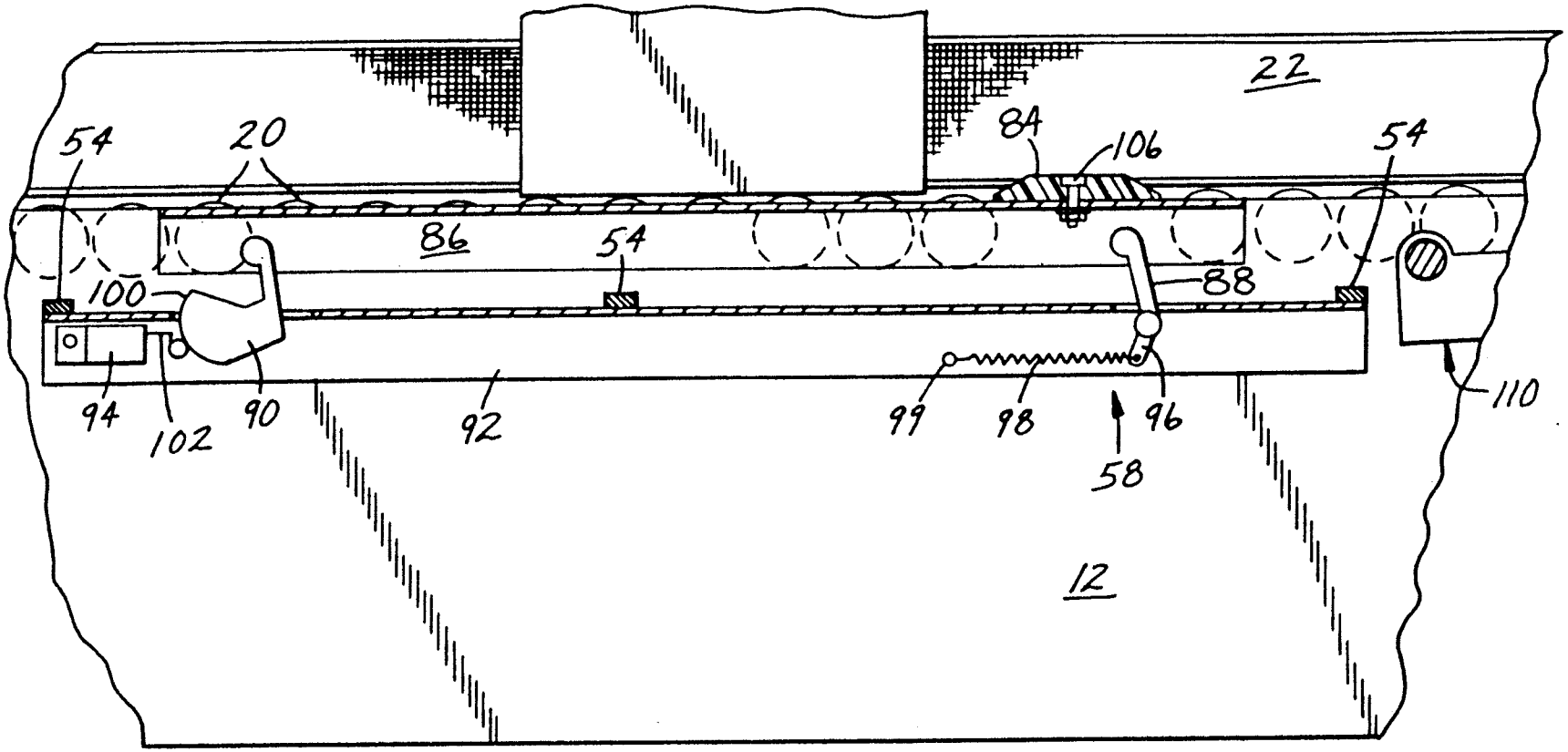
FIG. 8 is a view taken along line 8—8 in FIG. 13 showing a second cam mechanism in its biased raised position shortly after it has been released by a box driven through the machine.

The second cam mechanism 58 is similar to the first cam mechanism 56, and as shown in FIG. 8, is made up of a cam 84, moving bar 86, first and second swing links 88 and 90, a stationary bar 92 and a second three-way two position valve 94. The cam 84 is longitudinally adjustable with respect to the moving bar 86 in the manner and for the reasons described below. The stationary bar 92 is connected with the central frame members 48 by spacer elements 54 and the moving bar 86 moves in a generally parallel manner to the stationary bar 92 by the pivotal parallel connection of the first and second swing links 88 and 90 between the moving bar 86 and the stationary bar 92. A lower end 96 of the first swing link 88 is connected to a biasing means such as tension spring 98 which is connected at point 99 to the stationary bar 92 and which urges the moving bar 86 to its raised position where cam 84 extends above the plane of the bed of rollers 20. When an article, such as a box or carton, is driven on top of the cam 84, the moving bar 86 is forced downwardly against the bias of tension spring 98 to a point just below the plane of the bed of rollers 20. The second swing link 90 further includes a camming surface 100 against which a positioning element 102 of the second three-way two position valve 94 rides. Again, the positioning element 102 is biased toward an outward position, which as shown in FIG. 8 occurs when the moving bar 86 assumes an upwardmost position. When the moving bar 86 is forced downwardly under the weight of an article, the camming surface 100 forces the positioning element 102 inward of the three-way two position valve 94 defining one of the positions of the three-way two position valve 94.

Figure 5:
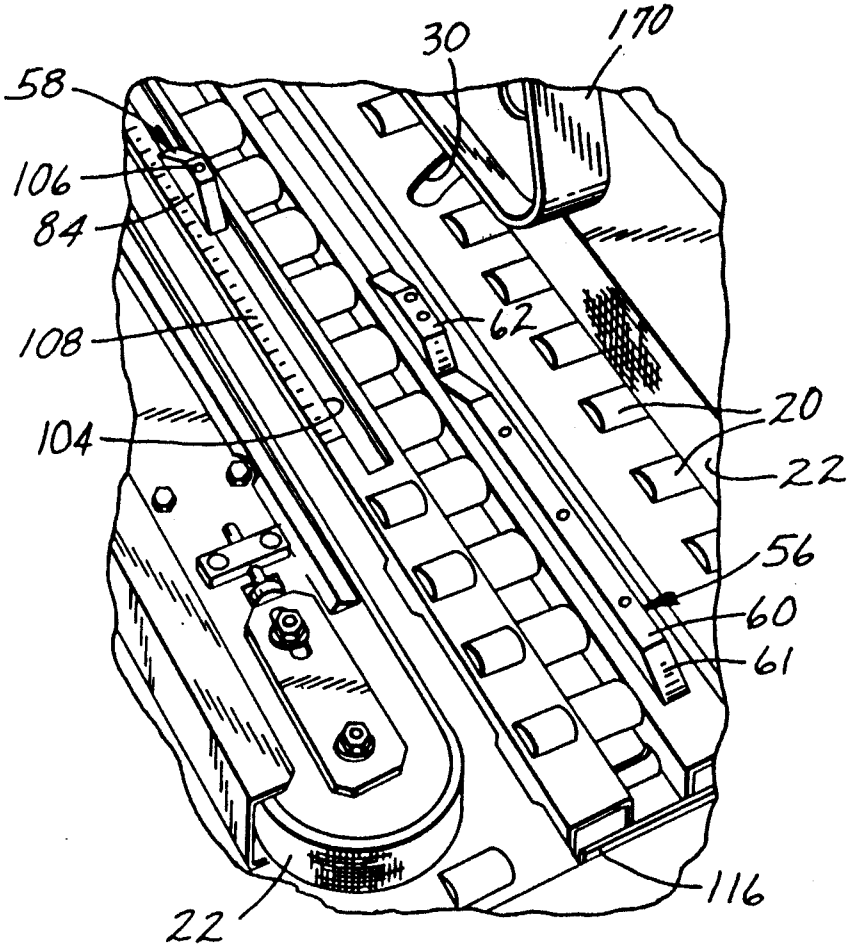
FIG. 5 is an enlarged partial perspective view of the cam mechanisms of the control system of the present invention.

The relationship between the first cam mechanism 56 and the second cam mechanism 58 is more clearly seen in FIG. 5. More specifically, the first and second cam portions 60 and 62 of the first cam mechanism 56 together are provided and positioned with respect to the base 12 so as to be encountered by a box or carton driven through the machine shortly after a front edge of such a box enters the box closing and sealing machine 10. Further down the line from a leading edge 61 of cam portion 60, cam 84 is provided in parallel alignment with cam portions 60 and 62. The cam 84 extends through a slot 104 of the upper surface 18 of the base 12, and the cam 84 is preferably slidably connected with the moving bar 86 to be adjustable for the reasons stated below in the operation of the subject machine. In order to lock cam 84 at a particular location along the slot 104, the cam 84 is provided with flanged side edges (not shown) which ride against the underneath surfaces of top surface 18 adjacent to the slot 104, and a set screw 106 is provided which can be urged against the upper surface of the moving bar 86 either directly or with the addition of a friction element (not shown). Thus, by tightening the set screw 106 the cam 84 is locked in place. It is also preferred that a scale 108 be provided as a reference for positioning cam 84 along the length of slot 104 in accordance with desired operating conditions which will be more fully understood in a description of the operation below. Note that the slot 104 includes at least a portion thereof which overlaps longitudinally with the combined length of the first and second cam portions 60 and 62 of the first cam mechanism 56.

Both cam mechanism 56 and 58 are maintained in their depressed positions for the entire time that a box or carton rides over any portion of them. Thus, since cam portions 60, 62 and 84 extend longitudinally of the machine 10, the time over which valves 78 and 94 are held against their bias positions is increased. This is particularly true of the cam mechanism 56 where cam portions 60 and 62 extend significantly longitudinally of the machine 10. The reason for such cam design will be apparent from the description of the operation below, and such cam design is very different from conventional limit switches, levers or photocells which do not extend longitudinally to any significance.

Also mounted between the central frame members 48 at a point closer to the infeed edge of the box closing and sealing machine 10 than the first and second cam mechanisms 56 and 58 is a gating mechanism 110. The gating mechanism 110 comprises a pair of side members 112 which are pivotally mounted at an inboard end thereof to a pivot rod 114 which is fixed in position to the central frame members 48. At the other ends of side members 112, a gate 116 is provided. The gate 116 is movable between an uppermost position wherein at least a portion thereof extends above the plane of the bed of rollers 20 sufficiently to obstruct entry of a box to the box closing and sealing machine 10 and a lowermost position where the gate lies below the plane of the bed of rollers 20 so that a box can pass thereover.

In order to move the gate 116 between its uppermost and lowermost positions, a pneumatic cylinder 118 is mounted to the end wall 19 of base 12 in a position to control the gating mechanism 110. More specifically, the pneumatic cylinder 118 includes a movable piston 120 which is driven by pneumatic cylinder 118 and an end 122 of which is connected with a flange portion 124 of the gate 116. Thus, by actuation of the pneumatic cylinder 118 to extend the movable piston 120 the gate 116 is raised to obstruct entry of boxes to the box closing and sealing machine 10 as shown in FIG. 6. When the pneumatic cylinder 118 is actuated to retract the movable position 120, as shown in FIG. 7, the gate 116 moves to its lowermost position allowing passage of a box thereover. The manner by which the pneumatic cylinder 118 is controlled will be move fully described below in the description of the control system of the present invention. It is understood that other types of drive means could be substituted for the pneumatic cylinder 118, such as electrical solenoids, mechanical actuators with or without electrical motors, or the like.

A lower taping head 126, as seen in FIG. 13, is also mounted between the central frame members 48 at a point closer to the exit end of the box closing and sealing machine 10 than the gate 116 and the first and second cam mechanisms 56 and 58. The lower taping head 126 is preferably conventionally mounted to the central frame members 48. Preferably, the lower taping head is mounted in the manner described in commonly owned copending U.S. patent application Ser. No. 07,611,997 filed Nov. 9, 1990, the contents of which are incorporated herein by reference. Typically, the lower taping head 126 comprises side plates from which mounting studs extend. These mounting studs then fit within slots provided on the central frame members 48. Examples of such taping heads are described in U.S. Pat. Nos. 3,915,786, 3,954,550 and 4,238,269. Preferably, the taping head comprises that available from Minnesota Mining and Manufacturing Company under the trademark "AccuGlide" which are available in a variety of sizes depending on the width of the tape that they apply. As seen in FIG. 2, a lower tape supply bracket 128 is further provided mounted to and downwardly depending from the tape head 126 and includes a lower tape supply drum 130 upon which a roll of tape can be mounted. Preferably, the lower tape supply drum 130 is rotatable about an axle 131 and the drum 130 rotates with the roll of tape.

Figure 3:
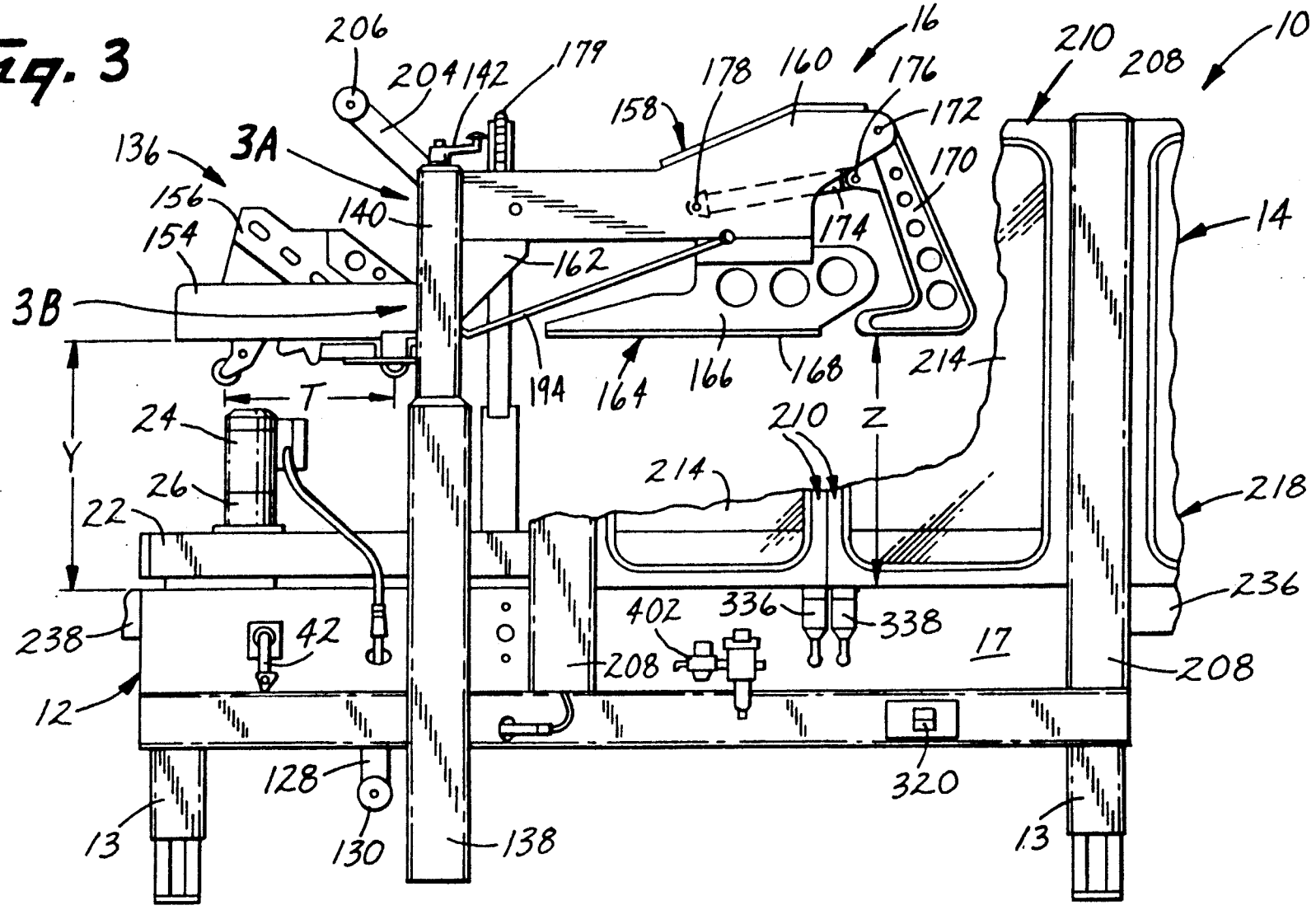
FIG. 3 is an enlarged side view similar to FIG. 2 but with the door assembly partially broken away.
Figure 3A:
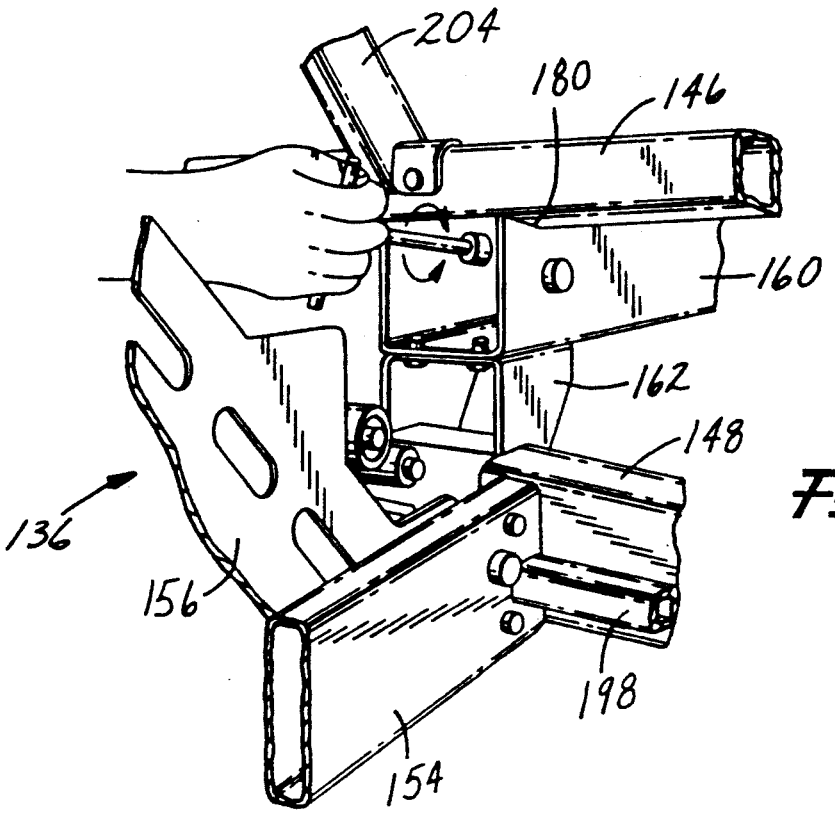
FIG. 3A is an enlarged partial perspective view taken from the arrow 3A in FIG. 3 illustrating the adjustment technique between the upper cross beam and the upper taping head assembly.
Figure 3B:
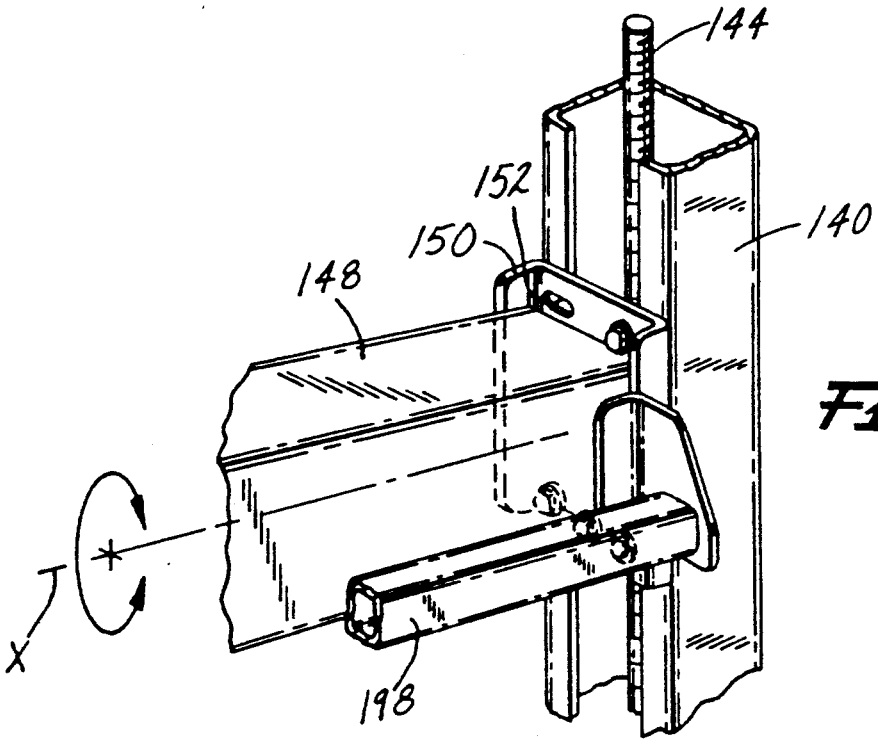
FIG. 3B is an enlarged partial perspective view taken from arrow 3B in FIG. 3 illustrating the connection between the lower cross beam of the upper taping head assembly and the movable upper strut of the upper taping head adjustment assembly.
Figure 9:
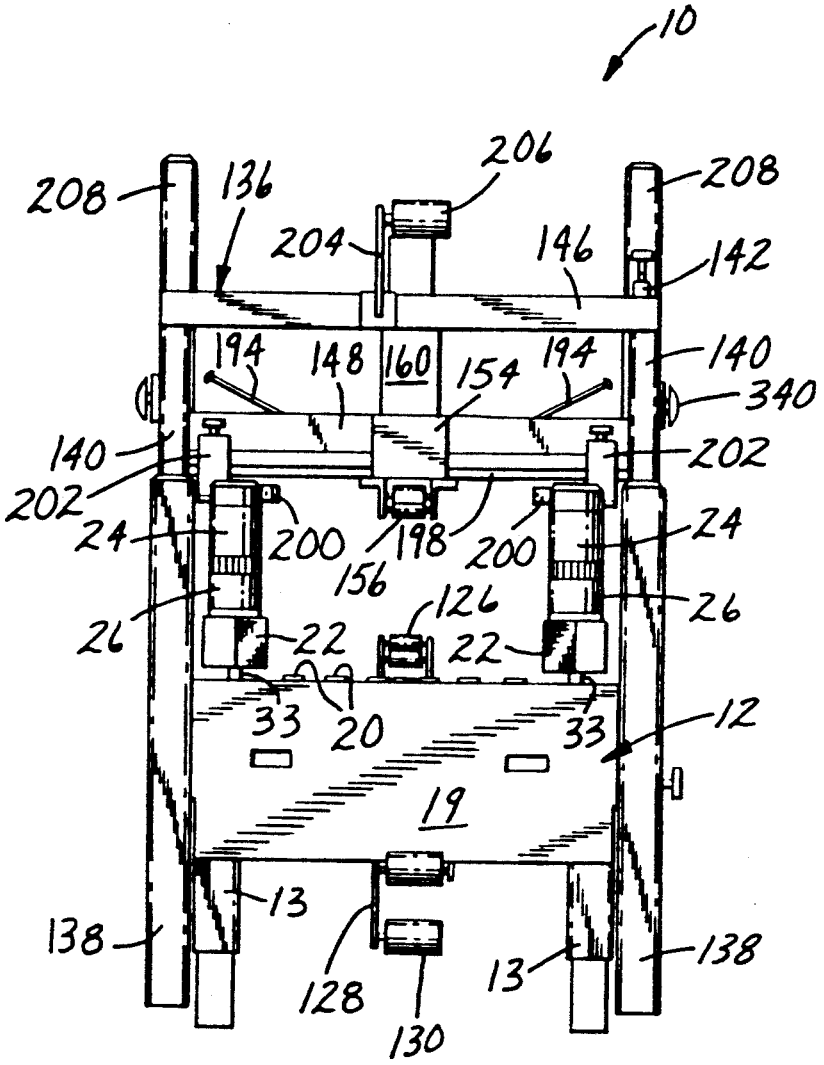
FIG. 9 is a front view of the box closing and sealing machine of FIG. 1.

Referring now to FIGS. 2, 3 and 9, an upper taping adjustment assembly 136 is provided at each side of the box closing and sealing machine 10 at a location generally adjacent to the lower taping head 126. Each upper taping head adjustment assembly 136 comprises a lower strut 138 which is fixed to the side walls 17 of the base 12 and a movable upper strut 140. The movable upper strut 140 telescopes within the fixed lower strut 138 and is guided therein by a roller and guide arrangement (not shown) of which any conventional guide arrangement can be utilized. Furthermore, a conventional lead screw drive mechanism is preferably provided within each upper taping head adjustment assemblies 136. More specifically, a lead screw 144, see FIG. 3B, is preferably provided within each upper strut 140 and lower strut 138 pair, and a hand crank 142 is provided atop at least one of the movable upper struts 140. The movable upper struts 140 are preferably connected together by an upper cross beam 146, and a transfer means such as a chain (not shown) is preferably provided within the upper cross beam 146 connecting the upper ends of the lead screws 144 on each side of the box closing and sealing machine 10. Thus, by activation of a single hand crank 142, both lead screw mechanisms are operated. Furthermore, a lead screw nut (not shown) is preferably fixed within each lower strut 138 and the lead screw 144 is threaded therethrough so that rotation of the lead screws 144 translates into raising or lowering operations of the movable upper struts 140 and the upper cross beam 146.

The upper taping head assembly 16 is also connected with and movable with the upper cross beam 146. The upper taping head assembly 16 includes a lower cross beam 148, see FIG. 9, which is also connected with the movable upper struts 140. As shown in FIG. 3B, a flange 150 is provided at each end of the lower cross beam 148, and each flange includes a plurality of oversized elongate holes 152 through which the lower cross beam 148 is bolted to the movable upper struts 140. The reason for providing such oversize elongate holes 152 will be more fully explained below. An upper taping head support frame 154 is also provided extending forwardly from the lower cross beam 148. An upper taping head 156 is then removably mounted to the upper taping head support frame 154 in a conventional manner, such as by studs and slots. Preferably, such mounting is also as described in the commonly owned copending U.S. patent application Ser. No. 07/611,997 filed Nov. 9, 1990, referenced above. The upper taping head 156, like the lower taping head 126 can be any conventional taping head, but is preferably of the type available from Minnesota Mining and Manufacturing Company under the trademark "AccuGlide".

The upper taping head assembly 16 further comprises a box flap folding means 158 which comprises a support member 160 which is fixed to the lower cross beam 148 by way of a bracket 162 and which includes a ski 164 mounted to a lower surface of the support member 160 which is used for engaging and folding a leading minor flap of a box driven through the box closing and sealing machine 10. The ski 164 comprises a web portion 166 and a horizontal flat portion 168, the lower surface of which engages and holds the leading minor box flap down until the major sides are folded thereover. The ski 164 is preferably adjustably mounted to the support member 160 so as to be longitudinally movable thereto and to accommodate a wide range of fixed proportions. Such adjustable mounting can comprise any conventional technique.

Figure 10:
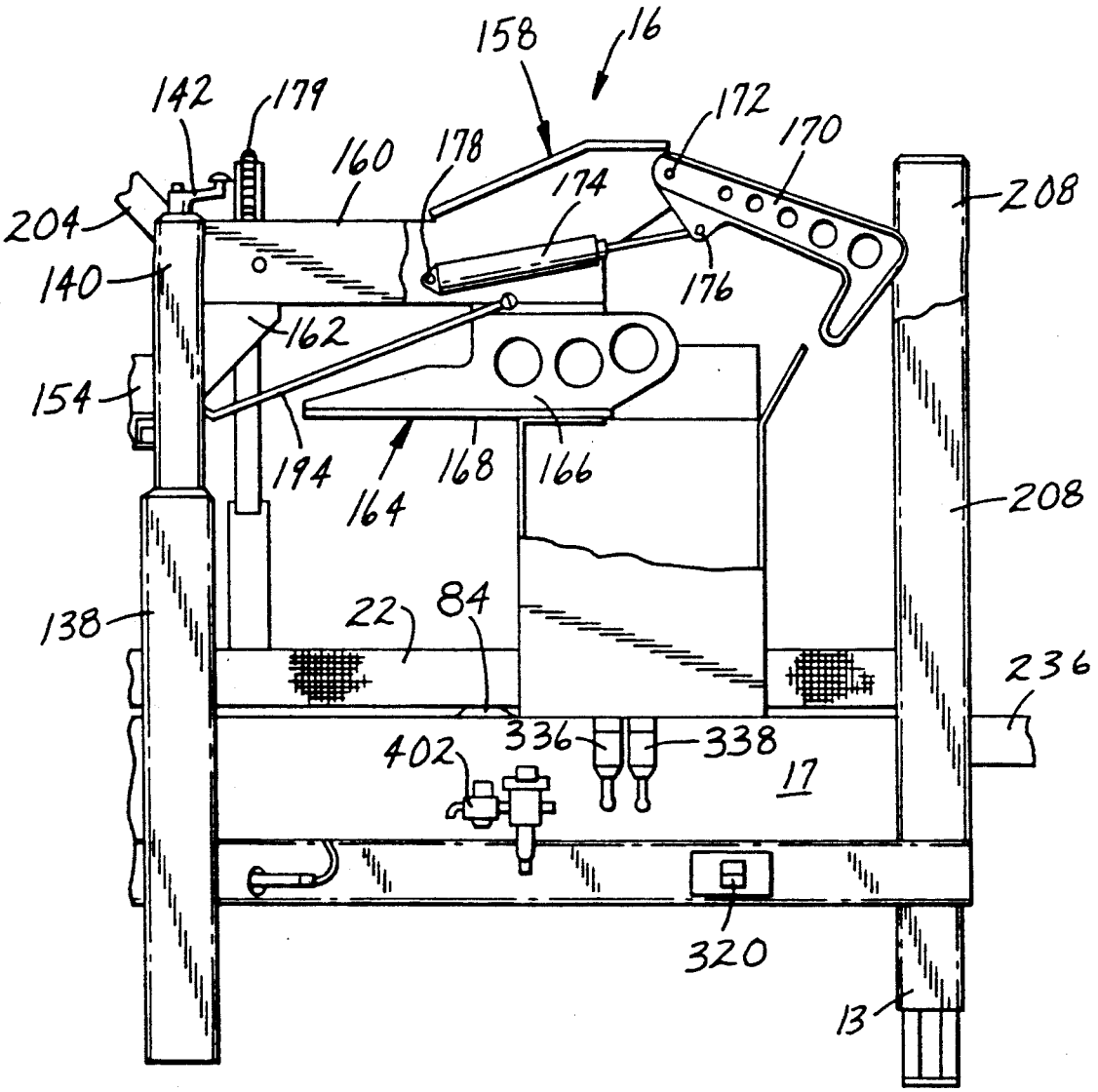
FIG. 10 is a partial break-away side view of the box closing and sealing machine of the present invention illustrating the box flap folding mechanism thereof.

A kicker 170 is pivotally mounted near the infeed end of the support member 160 at a pivot pin 172. The kicker 170 is operative between a raised position, as shown in FIG. 10 and a lowered position, as shown in FIG. 3, and is used to fold the trailing minor flap of a box driven through the box closing and sealing machine 10. In order to drive the kicker 170 between the raised and lowered positions, a pneumatic cylinder 174, see FIG. 10, is preferably used. Specifically, the pneumatic cylinder 174 is pivotally connected to the kicker 170 at a point 176 spaced from the pivot pin 172 and at the other end thereof to the support member 160 at a point 178 also spaced from the pivot pin 172. Thus, by activation of the pneumatic cylinder 174 in one direction or the other, the raised and lowered positions are defined. The circuit for controllably operating the pneumatic cylinder 174 will be more fully understood in the description of the control system below. An air line and support therefor is shown at 179 for providing pressurized air to the support member 160. Additional air lines (not shown) are appropriately connected with the pneumatic cylinder 174.

Figure 4:
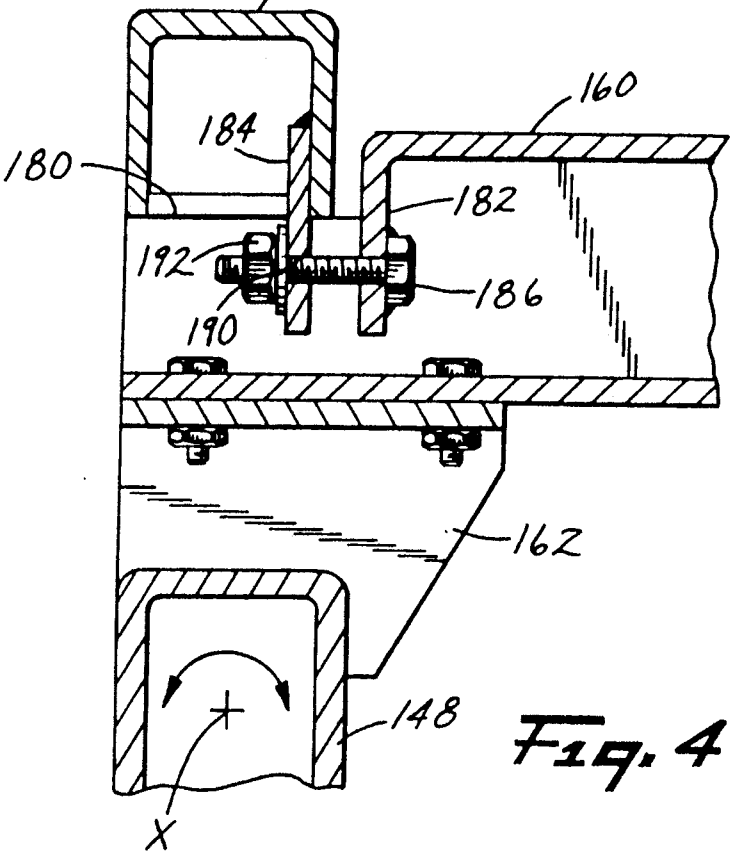
FIG. 4 is a longitudinal partial cross-sectional view taken through FIG. 3A illustrating the adjustment between the upper taping head assembly and the upper cross beam.

In addition to the connection of the support member 160 to the lower cross beam 148 described above, the support member 160 is further connected with the upper cross beam 146. Moreover, the support member 160 is adjustably connected with the upper cross beam 146. As illustrated in FIGS. 3A and 4, the support member 160 has a cutout portion 180 at the forward end thereof within which the upper cross beam 146 sits. The support member 160 further includes a plate portion 182 which extends downwardly from the top wall of support member 160 adjacent to the cutout portion 180. The upper cross beam 146 is further provided with a downwardly extending plate 184 which is fixed, such as by welding, to the upper cross beam 146 and which is positioned to overlap the plate portion 182 of the support member 160. A stud 186 is fixed, such as by welding, with the plate portion 182 of the support member 160 and extends forwardly through a hole 190 provided through the plate 184 from the upper cross beam 146. A self-locking nut 192 is threaded on the end of the stud 186 which is extended through hole 190. The hole 190 is sufficiently large so that the stud 186 has room to swing in an arcuate path with plate 182 and support member 160 about axis X.

The adjustment of the support member 160 relative to the upper cross beam 146 is accomplished by rotating the support member 160, the bracket 162, and the lower cross beam 148 about a central axis X of the lower cross beam 148. By tightening the self-locking nut 192 onto the stud 186, the plate 182 of the support member 160 is moved closer to the plate 184 of the upper cross beam 146, and thus the lower cross beam 148 and support member 160 are moved counterclockwise, viewed in FIG. 4, about axis X. Likewise, as the self-locking nut 192 is loosened, the effective length of the stud 186 is increased and the spacing between plates 182 and 184 is increased so that the lower cross beam 148 and the support member 160 move relatively clockwise about axis X. Since the length of support member 160 and the weight of that member combined with the ski 164 and kicker 170 create a moment which is substantially greater than the moment created by the upper taping head support frame 154 and the upper taping head 156, there is a natural tendency for the support member 160 and lower cross beam 148 to move clockwise. Thus, the above described arrangement takes advantage of this natural tendency. It is of course understood that many other arrangements are possible for positively increasing and decreasing the distance between plate 182 and 184 in their adjusted positions.

In order to permit the above-described rotational movement of the support member 160 and the lower cross beam 148, the lower cross beam 148 must be somewhat rotatably mounted to the movable upper struts 140 of the upper taping head adjustment assemblies 136. Referring again to FIG. 3B, the oversized elongate holes 152 through flange 150 through which each of the mounting bolts pass provide the necessary adjustment.

By this arrangement, the upper taping head assembly 16 can be quickly and easily leveled as follows. First, reference measurements are made at Y and Z shown in FIG. 3. Distances Y and Z should be equal for leveling both the upper taping head 156 and the ski 164 of the box flap folding means 158. If the distances Y and Z are not equal, the plurality of bolts passing through flange 150 of the lower cross beam 148 are loosened sufficiently so that the lower cross beam 148 can move about axis X. Next, as shown in FIG. 3A, an operator could level the device by simply turning the self-locking nut 192 either clockwise or counterclockwise, depending on the desired result. If distance Z is less than distance Y, the support member 160 and lower cross beam 148 need to be moved counterclockwise as shown in FIGS. 3 and 4. This is accomplished by tightening the self-locking nut 192. If distance Z is larger than distance Y, clockwise movement of support member 160 and lower cross beam 148 as shown in FIG. 3 and 4 is necessary which is accomplished by loosening the self-locking nut 192. Once the distances Y and Z are equal or within a set tolerance, the bolts securing flange 150 of the lower cross beam 148 are tightened to the movable upper strut 140. Such adjustment is particularly beneficial at the time of setting up the machine initially, and permits any number of readjustments which may become necessary over time and usage of the box closing and sealing machine 10.

Figure 14:
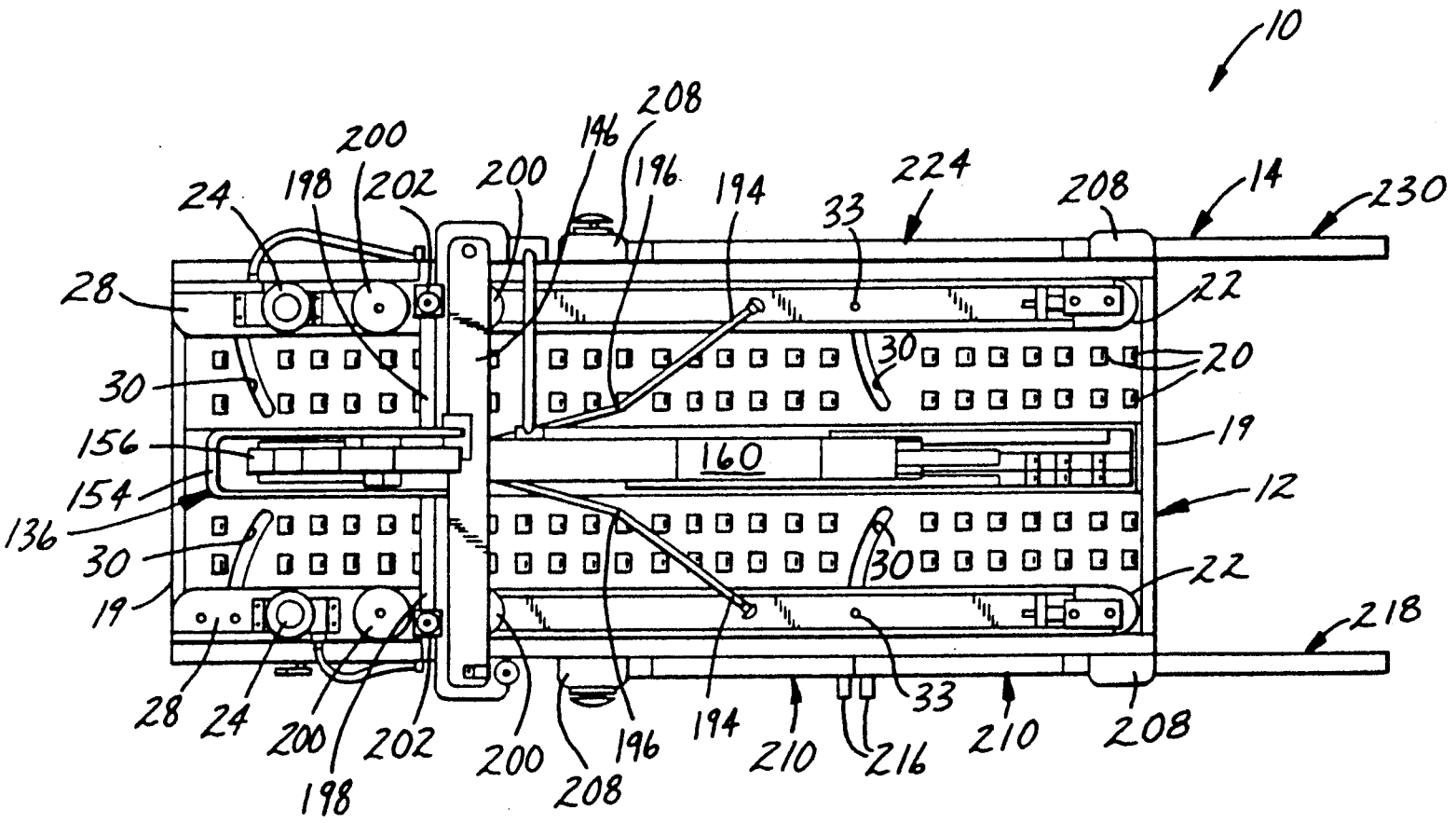
FIG. 14 is a top view of the box closing and sealing machine of FIG. 1.

Referring now to FIGS. 3 and 14, major side flap folding rods 194 are shown which are connected with the lower cross beam 148 and which extend toward the infeed end of the box closing and sealing machine 10. The major side flap folding rods 194 extend upwardly and rearwardly and diverge from one another, and preferably are further provided with elbows 196 which divide each major side flap folding rod 194 into portions. The major side flap folding rods 194 engage with the upper major side flaps of a box as it is driven through the box closing and sealing machine 10, and as the box is moved forwardly, the converging of the major side flap folding rods 194 and the downward inclination thereof result in the upper major side flaps of the box being folded over the leading and trailing minor flaps. The elbows 196 advantageously provide for a more controlled closing of the upper major side flaps.

Another feature attached to the lower cross beam 148 is an adjustable roller assembly, as best shown in FIG. 14, which comprises support rods 198 onto which rollers 200 are slidably mounted. More particularly, the rollers 200 are pivotally mounted to a support block 202, and the supports blocks 202 are slidably mounted on the support rods 198. Preferably, the support blocks 202 include conventional means for locking them in fixed position along the support rods 198. The rollers 200 are disposed just below the upper taping head 156 and they are to be adjusted along the support rods 198 such that they engage with the upper side edges of a box when driven through the machine at the taping stage to prevent separation of the major side flap edges from one another during taping.

An upper tape supply bracket 204 and upper tape supply drum 206 are also preferably mounted to the upper cross beam 146. Like the lower tape supply bracket and drum 128 and 130, respectively, the upper tape supply bracket and drum 204 and 206, respectively, rotationally support a roll of tape which is fed to the upper taping head 156. In this regard, the upper tape supply bracket 204 and drum 206 should be transversely positioned on the upper cross beam 146 at substantially the same transverse location as the upper taping head 156.

Referring again to FIG. 1, the protective door assembly 14 will be described in greater detail below. The protective door assembly 14 includes four vertical columns 208, two on each side of the box closing and sealing machine 10, which are connected to the base 12 at the sidewalls 17 thereof. The manner of attaching the vertical columns 208 to the sidewalls 17 can be any conventional suitable attachment technique such as mechanical fasteners, welding, adhesives or the like. Preferably, bolts are used.

Between the two vertical columns 208 of one side of the box closing and sealing machine 10, a pair of doors 210 are provided which together substantially take up the space between the vertical columns 208 above base 12. Each door 210 preferably comprises a peripheral frame 212 and a window pane 214. Moreover, one vertical edge of each peripheral frame 212 is preferably hingedly attached to the vertical columns 208 by conventional hinge pins or the like so that the doors 210 can open outwardly from the box closing and sealing machine 10. Handles 216 are provided to facilitate opening and closing the doors 210. On the same side of the box closing and sealing machine 10 as the doors 210, a stationary panel 218 is connected to the rear vertical column 208 so as to extend rearwardly therefrom. The panel 218, like doors 210, comprises a peripheral frame 220 and a window pane 222.

On the other side of the box closing and sealing machine 10, a relatively large panel 224 is connected between the vertical columns 208 so as to substantially entirely take up the space between the columns 208 above the base 12. The panel 224 also comprises a peripheral frame 226 and a window pane 228. Like panel 218, a panel 230 is attached to the rear vertical column 208 of the other side to extend rearwardly therefrom. Again, panel 230 comprises a peripheral frame 232 and a window pane 234.

The provision of the protective door assembly 14 surrounding a substantial portion of the box closing and sealing machine 10 advantageously defines a safety zone within which the moving parts of the box closing and sealing machine 10 operate. Moreover, the rear panels 218 and 230 extend such a zone over a portion of the conveyor leading to the box closing and sealing machine 10.

A description of the operation of the box closing and sealing machine 10 will now be described with the understanding that the description of the control system below will provide a complete understanding of how such operations take place. With reference first to FIG. 2, a box needing its upper minor and major flaps folded and the top and bottom thereof sealed by lengths of tape is brought to the machine on any conventional conveying means. Such conveying means may be power driven, gravity driven or otherwise. A portion of such conveyor is indicated at 236. In a typical situation, a number of such boxes will be waiting on the conveyor 236 to be closed and sealed. A first box will enter the box closing and sealing machine 10 and be driven by the side drive belts 22 through the box closing and sealing machine 10. Of course, the side drive belts 22 and the rollers 200 are previously set according to the width of boxes to be closed and sealed. As the box is driven forwardly from the infeed edge, the leading edge of the box hits the leading edge 61 of cam portion 60 of the first cam mechanism 56 and quickly forces the cam portions 60 and 62 together below the plane of the bed of rollers 20. By the actuation of the first cam mechanism 56 in this manner, the gate 116 of the gating mechanism 110 is raised by the pneumatic cylinder 118 to prevent a next box from entry to the box closing and sealing machine 10. As used throughout this application, it is understood that what is meant by raising the gate 116 is that the pneumatic cylinder 118 is actuated to raise the gate. In fact, the weight of the box may prevent the actual raising; however the gate 116 will raise immediately after the box passes thereover.

At the time of the initial entry of the box into the box closing and sealing machine 10, the kicker 170 is in its starting position which is its raised position. Thus, the box with the upper flaps unfolded passes under the kicker 170. The actuation of the first cam mechanism 56 also is used in accordance with the preferred embodiment of the present invention to ready the kicker circuit, which will be explained in greater detail below. Referring now to FIG. 10, the box continues forward and the ski 164 folds the leading minor flap of the box. Then, depending on the length of the box and the set position of the cam 84 along slot 104, the leading edge of the box urges cam 84 downwardly and below the plane of the bed of rollers 20. By depressing the cam 84, the kicker 170 is actuated. As a result, the trailing minor flap is folded downwardly and it is then held downwardly by the ski 164. As shown in FIG. 7, when the trailing edge of the box leaves cam portion 62 of the first cam mechanism 56, the cam portions 60 and 62 move upward to their biased position at which time the gate 116 is lowered and the kicker 170 is raised. Thus, a next box enters the box closing and sealing machine 10. As shown in FIG. 8, as the first box continues forward movement, it eventually leaves cam 84 and the machine 10 is reset. Thus, the kicker and gate assemblies are ready for their next cycle and the next box. As described above, the up and down movement of the first and second cam mechanisms 56 and 58, respectively, changes the three-way two position valves 78 and 94, respectively, to control such kicker and gating movements as further explained below.

As the box continues forward with the upper leading and trailing minor flaps held folded by the ski 164, the upper major side flaps are folded on top of the minor flaps under the influence of the major side flap folding rods 194. At this point, the folding of the box is complete. Thereafter, the box continues traveling forward and passes through the sealing region which comprises the upper and lower taping heads 156 and 126, respectively. In this region, the boxes are sealed by a length of tape applied to the bottom and top of the box in a well known manner. Specifically, the length of tape preferably starts on the vertical front wall of the box then is adhered to the abutting faces of the major side flaps, and then a distance along the rear vertical wall. Similar tape lengths are preferably applied top and bottom. It is of course understood that any one or the other of the upper or taping heads 156 and 126, respectively, could be eliminated if not necessary to seal the box. The closed and sealed box then exits the box closing and sealing machine 10 and can conventionally be moved to another area by any conventional conveying means, a portion of which is illustrated in FIG. 2 at 238.

The control system for the box closing and sealing machine 10 will now be described, and such control system is basically comprised of an electrical circuit, shown in FIG. 12, and a pneumatic circuit shown at various operational stages in FIGS. 11A, B and C. Beginning with the electrical circuit shown in FIG. 12, the circuit 300 supplies power from a power source (not shown) by way of supply lines 302 and 304 and through a switching assembly 306 for energizing a solenoid valve 308 and the pair of electrical motors 24 which drive the side drive belts 22, described above. Power from the supply lines 302 and 304 is supplied to the switching assembly 306 over lines 310 and 312. The switching assembly 306 comprises three switches 314, 316 and 318 which are connected together mechanically so as to be thrown together and as actuated by a mechanical actuator 320. Lines 322, 324 and 326 exit switching assembly 306, and line 324 runs from switch 316 of the switching assembly 306 back to the switching assembly 306 for connection with switch 318. Thus, as mechanical actuator 320 is manipulated, from the position shown in FIG. 12, switches 314, 316 and 318 connect with lines 310, 312 and 324, respectively, so that power is supplied from the switching assembly 306 through lines 322 and 326. By way of junctions 328 and 330 the power is supplied to each of the electrical motors 24 and to the solenoid valve 308. Additionally, the electrical motors 24 are connected to a grounded third wire generally noted 332 in a conventional manner. Thus, when mechanical actuator 320 is manipulated from the FIG. 12 position, power is supplied to both the electrical motors 24 and the solenoid valve 308 at the same time.

An additional control circuit is provided comprising a line 334 which is connected between lines 310 and 312.

Along line 334, limit switches 336 and 338, and emergency stop switches 340 and 342 are provided. Specifically, the limit switches 336 and 338 are provided, as shown in FIG. 2, for sensing whether or not the doors 210 are closed. When the doors 210 are closed, the limit switches 336 and 338 assume positions connecting control line 334 permitting current to pass. In a similar manner, the emergency stop switches 340 and 342, one of which is shown on one of the vertical columns 208 of the protective door assembly 14 and the other of which is similarly located on the opposite side of the machine, are normally positioned to permit current passage for connecting the control line 334. In an emergency stop situation, either of the emergency switches 340 or 342 can be pushed to break the current through control line 334. After this series of limit switches 336 and 338 and emergency stop switches 340 and 342, a low voltage sensor 344 is provided in control line 334. Moreover, the low voltage sensor 344 is connected with the mechanical actuator 320. From the low voltage sensor 344, current continues through control line 334 to connect with line 312. The low voltage sensor 344 senses the voltage supplied through control line 334 and if the voltage is below a preset value, the machine is turned off by way of its connection to the mechanical actuator 320. Such may occur if the voltage on supply lines 302 and 304 is below the predetermined value, or if any one of the limit switches 336 or 338 or the emergency stop switches 340 or 342 are tripped.

Figure 11A:
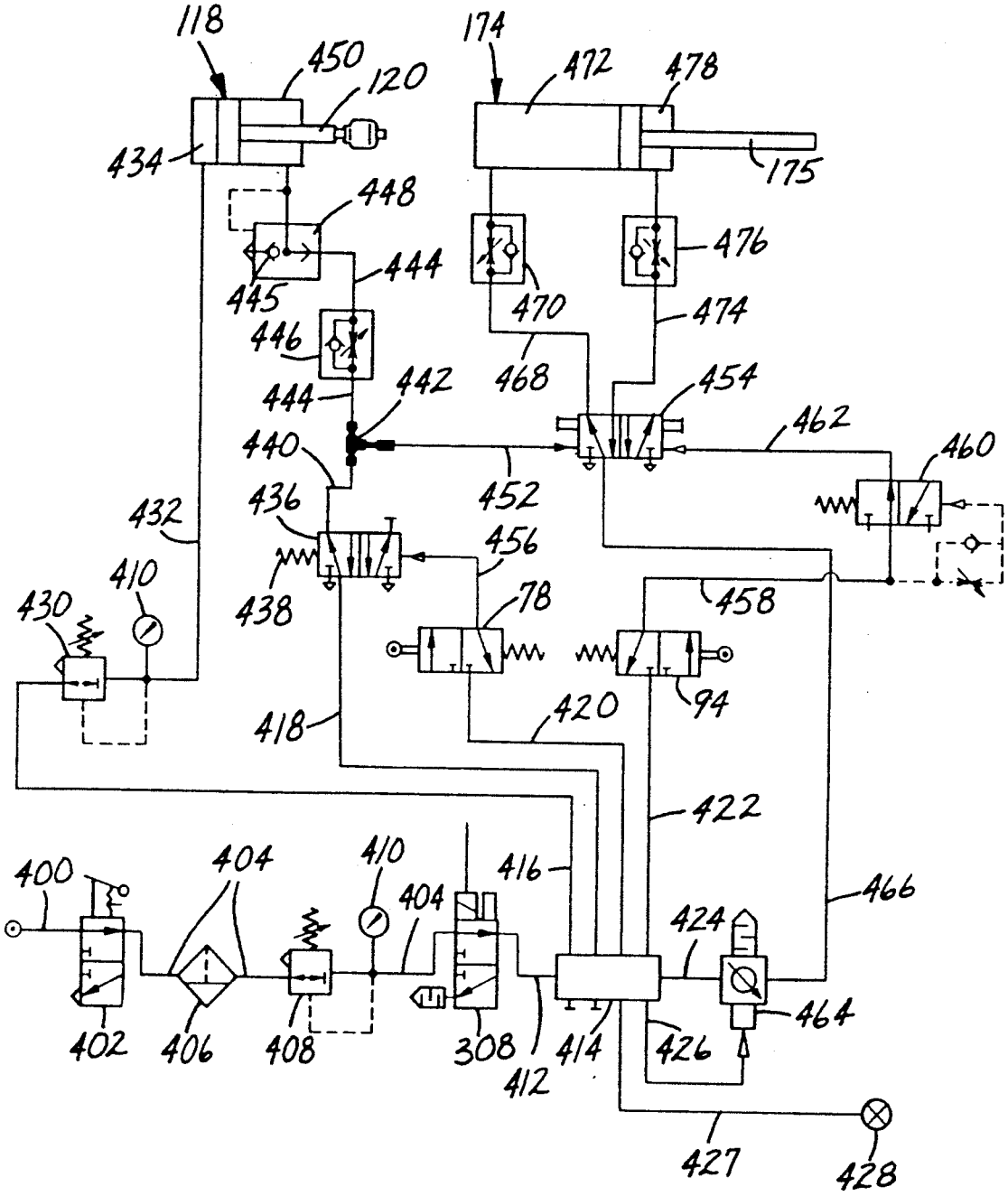
FIGS. 11A, B and C are pneumatic circuit diagrams for the box closing and sealing machine of the present invention, where
Figure 12:
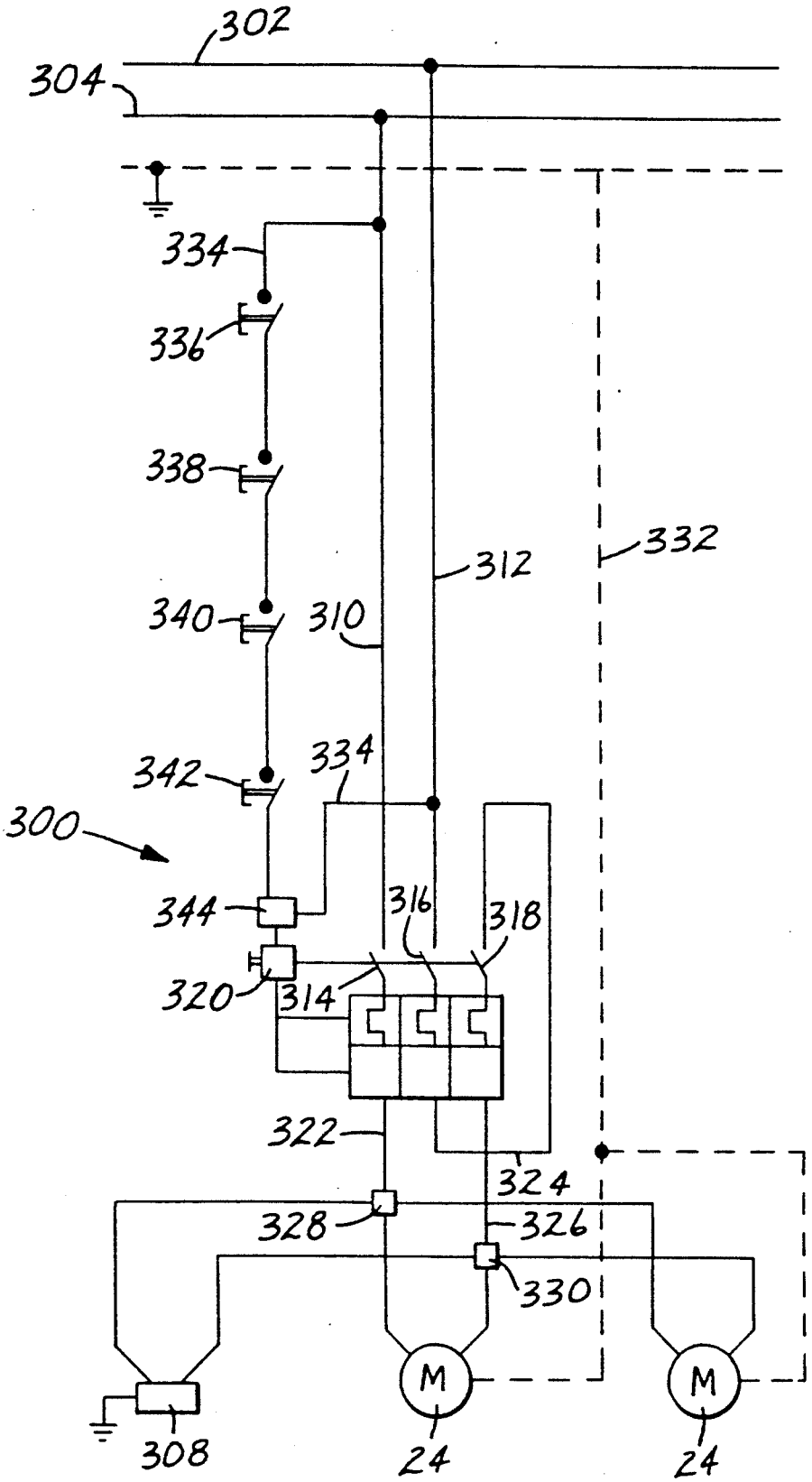
FIG. 12 is an electric schematic diagram for the box closing and sealing machine of the present invention.

Referring now to FIGS. 11A, B and C, the pneumatic circuit of the box closing and sealing machine 10 will be described. FIG. 11A illustrates the circuit with the valves and cylinders positioned at a time when the box closing and sealing machine 10 is energized by connection to its power source, described above, and with both cam mechanisms 56 and 58 in their raised biased positions. An air supply line 400 is connected with an air source (not shown), and connects with a mechanical valve 402 which is located on the side of the machine 10 as shown in FIG. 2. The mechanical valve 402 includes an on and an off position which permits or blocks air flow therethrough. For the circuit to be operable, the mechanical valve 402 is opened and leads to line 404. Line 404 includes a filter 406, a pressure regulator 408 including a gauge 410, and is then connected with the solenoid valve 308, described above. The solenoid valve 308, when actuated in accordance with the electrical circuit described above, permits air flow therethrough as shown in FIG. 11A, to a next line 412. If the solenoid valve 308 is not energized, that is power is not sufficiently provided to the machine or any one of the aforementioned limit switches or emergency stop switches are thrown, air cannot flow through the solenoid valve 308. Line 412 leads to a distributor block 414 from which the pressurized air is distributed to lines 416, 418, 420, 422, 424, 426 and 427. Line 427 leads to an air pressure indicator 428, which can be seen in FIG. 1 and is preferably located on the support member 160 of the upper taping head assembly 16. The indicator 428 can comprise any conventional indicator which reacts in a visible way when pressurized air is supplied in line 427 so that an operator can tell that air pressure has made it to the machine, particularly distributor block 414 and that the machine is ready for operation.

Line 416 is connected with a pressure regulator 430 which reduces the air pressure to line 432 from that supplied by line 416. Line 432 is then connected with one side of the pneumatic cylinder 118 which controls the gate operation described above. The pneumatic cylinder 118 includes a first chamber 434 into which the air from line 432 is supplied. Air within the first chamber 434 tends to move the movable piston 120 to the right as viewed in FIG. 11A.

At the same time, air pressure is supplied through line 418 to a valve 436. In this state, air passes through valve 436 which lies in its rest position under the influence of a biasing means 438. The pressurized air leaves valve 436 through line 440 which connects with a T fitting 442. The air leaves the T fitting 442 through a first line 444, which passes through a flow regulator 446, through a quick exhaust valve 448, and into a second chamber 450 of the pneumatic cylinder 118. Air within the second chamber 450 tends to urge the movable piston 120 towards the left in FIG. 11A against the air pressure within the first chamber 434. Moreover, since the air pressure within the first chamber 434 has been reduced by the pressure regulator 430, the higher air pressure within the second chamber 450 results in the movable piston 120 being shifted to its retracted position.

Also leaving T fitting 442, a line 452 runs to another valve 454. The air pressure within line 452 tends to urge the valve 454 to a right-most position as shown in FIG. 11A the effect of which will be described below.

Line 420, after leaving the distributor block 414, leads to the first three-way two position valve 78, described above, which controls the gating mechanism 110. Since valve 78 is in its biased position at this stage, no air passes therethrough. A line 456 is provided from the valve 78 to the valve 436, which has no effect on valve 436 at this stage, since air does not pass through valve 78.

Line 422, also exiting from distributor block 414, leads to the second three-way two position valve 94 described above, for actuating the kicker 170. Likewise as valve 78, valve 94 remains in its biased position at this stage and no air passes therethrough. A line 458 leads from the valve 94 to one shot valve 460. The one shot valve 460 is a valve mechanism by which a continuous supply of air is converted into a single measured pulse of air which will be supplied through line 462 under appropriate circumstances described below. At the present stage, no such pulse is created since no air is supplied in line 458 with valve 94 closed.

Lines 424 and 426, leaving the distributor block 414, both lead to a slow start valve 464 which gradually controls air pressure up to full pressure into line 466. Such is accomplished by a control orifice within slow start valve 464 through which air from line 426 passes. Such air then acts against a biased valve which gradually fully opens as the pressure builds beyond the control orifice to eventually allow full passage of air from line 424 to line 466. Line 466 then leads to valve 454 which is positioned by the influence of air pressure within line 452, as illustrated in FIG. 11A, to permit air passage therethrough and onto line 468. Line 468 passes through a flow regulator 470 and into a first chamber 472 of the pneumatic cylinder 174 of the kicker 170. The air pressure within the chamber 472 forces the piston 175 of the air cylinder 174 outward. As shown in FIG. 10, when the cylinder 174 is extended, the kicker 170 is raised. The purpose of the slow start valve 464 is to control the raising of the kicker 170 to be raised gradually.

The start up condition of the pneumatic circuit has now been described, and it is apparent that the gate 116 of the gating mechanism is positioned downward so as not to block entry of a box onto the machine 10, and the kicker 170 is raised to permit a box to pass thereunder. The machine assumes this configuration provided the mechanical valve 402 is open, air pressure is supplied by line 400, and, as a result of connecting the machine 10 to a power source, the solenoid valve 308 is opened to allow air pressure into the entire system.

Figure 11B:
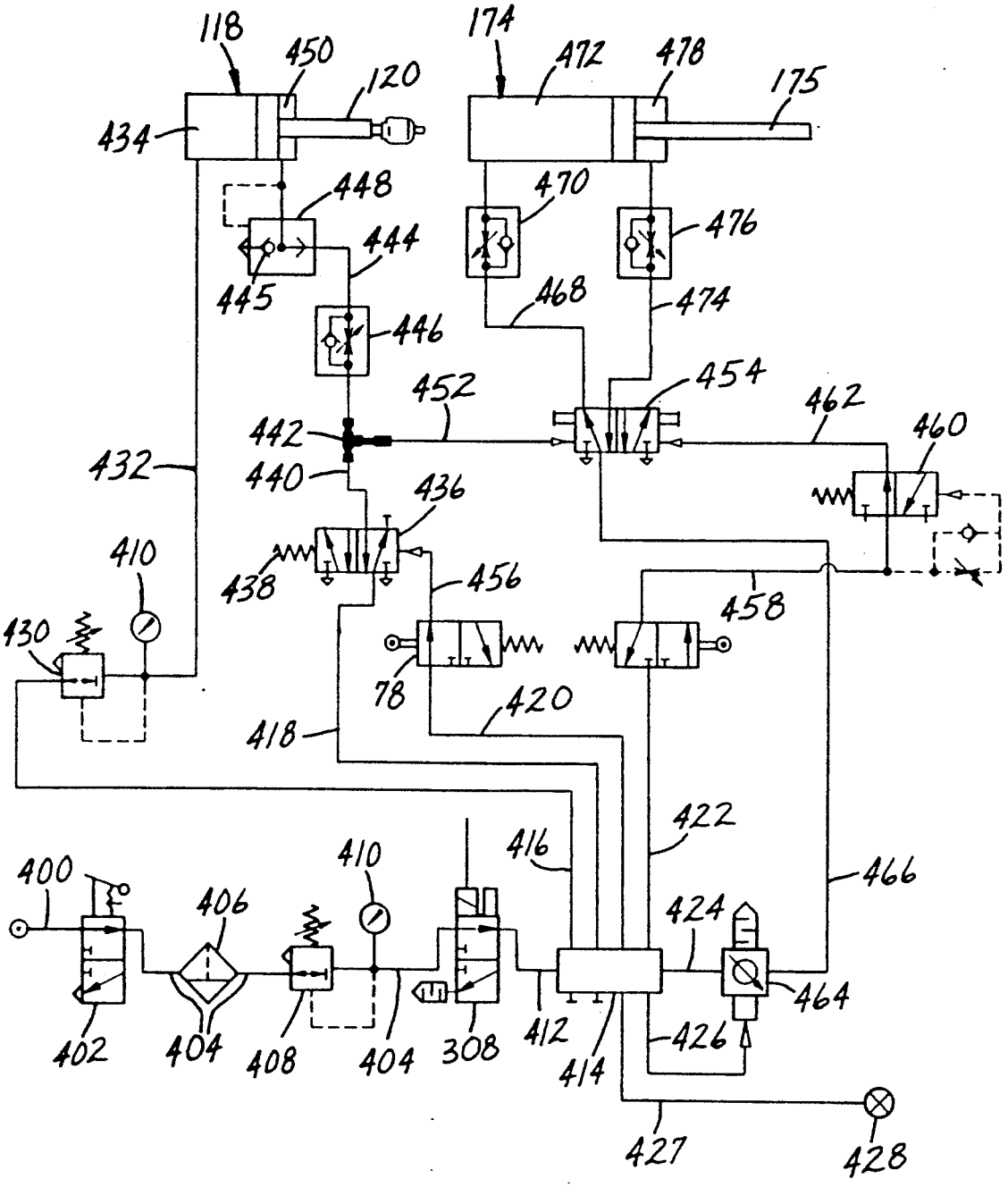
FIG. 11B shows the circuit with the first cam mechanism depressed and the second cam mechanism at rest.

The first change to the circuit occurs when a box is driven into the machine 10 sufficiently that the first cam mechanism 56 is activated. This happens as a result of the front edge of the box contacting the first cam portion 60. The circuit then continues unchanged for as long as the first and second cam portions 60 and 62 are depressed until the second cam mechanism 58 is activated, which affects the circuit as explained below. More specifically, as the first cam mechanism 56 is actuated, the first three-way two position valve 78 is urged against its spring bias so that line 420 is now connected with line 456 through valve 78. As a result, air pressure is supplied to the right side of valve 436 as seen in FIG. 11B, which urges it against the bias means 438. Thus, line 440 is connected to an exhaust port of valve 436 so that the air within lines 452 and 444 are drained. Moreover, the air within second chamber 450 of the pneumatic cylinder 118 exits through the quick exhaust valve 448. This happens because the reduced pressure in line 444 moves a check valve 445 away from a large orifice through which the air is quickly exhausted from the second chamber 450. Thus, the piston 120 is extended outwardly of the air cylinder 118 under the influence of the unaffected air pressure provided within the first chamber 434 from line 432. The result is the raising of the gate 116. Thus, for the time that the first cam mechanism is depressed, the valve 78 ensures that the gate 116 remains up and that no boxes can enter the machine 10. Such occurs during the entire time that a box rides on and depresses both the first and second cam portions 60 and 62 of the first cam mechanism 56.

Additionally, since line 452 is also drained as a result of the action of valve 436, pressure is removed from the left side of valve 454, as viewed in FIG. 11B. However, the valve 454 does not immediately change its position since it is not under any bias force or new positive pressure in line 462 at this time. Moreover, since the second cam mechanism 58 is not yet actuated, the kicker 170 remains raised, and the circuit therefor remains unchanged.

Figure 11C:
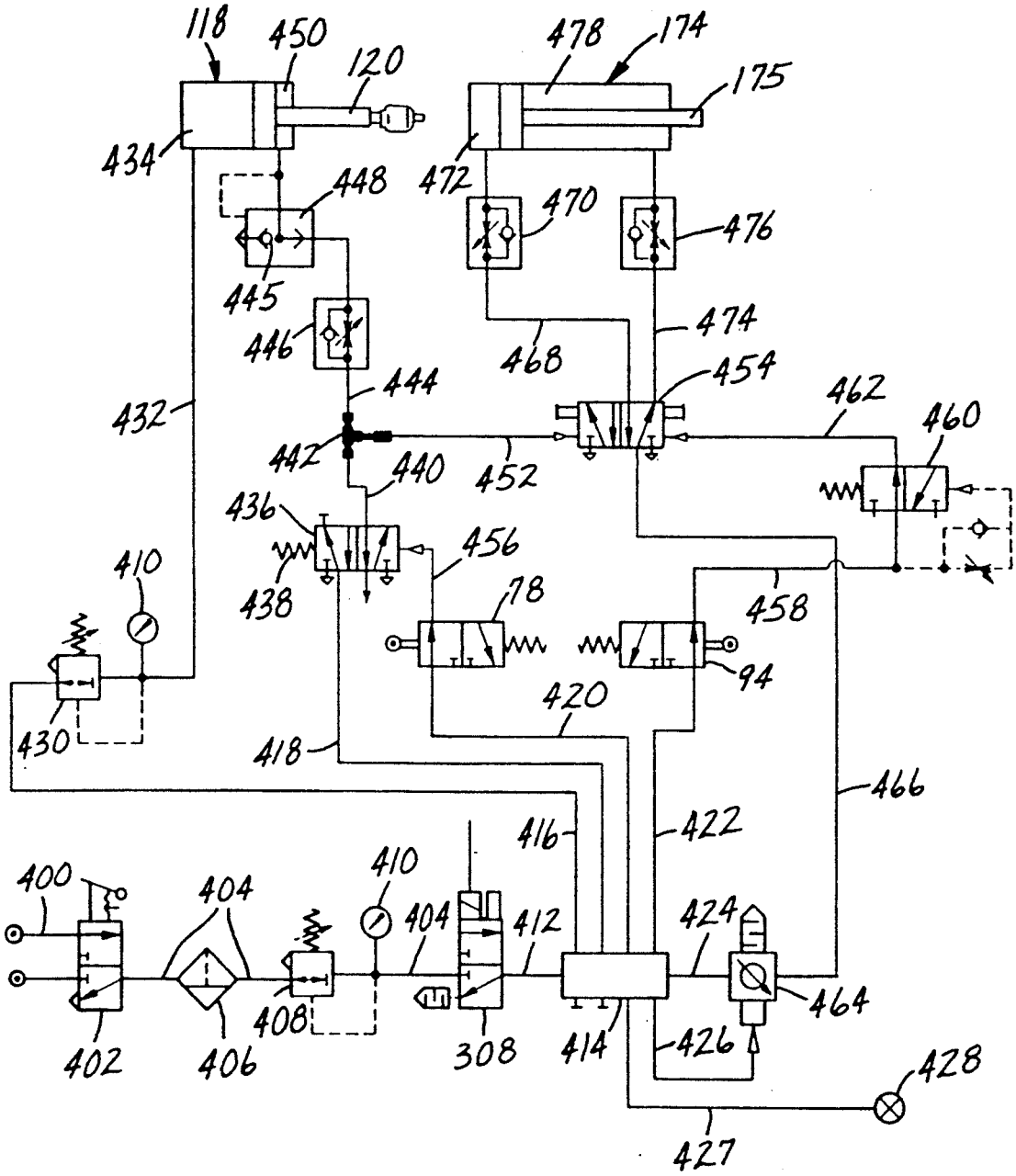
FIG. 11C shows the circuit when both cam mechanisms are depressed.

Referring now to FIG. 11C, the pneumatic circuit is illustrated with both of the cam mechanisms 56 and 58 depressed. Such occurs, when the box advances sufficiently forwardly to not only depress the first cam portion 60 of the first cam mechanism 56 but also the cam 84 of the second cam mechanism 58. Such circuit stays the same during the time which both cams are held depressed along the lengths thereof. Specifically, the circuit changes by the second three-way two position valve 94 being urged against its spring bias so as to connect line 422 with line 458. As pressure is supplied by line 458 to the one shot valve 460, a measured pulse of air is generated and is supplied within line 462 to act against valve 454. As described above, since the first valve 78 is maintained depressed, line 452 is drained. Thus, the single measured pulse within line 462 is sufficient to shift valve 454. The one shot valve 460 is conventionally available for converting such a continuous air supply into a pulse which is reset when the continuous supply is interrupted. Each time then a new continuous supply is provided, a single measured pulse is generated.

As a result of the shifting of valve 454, line 466 is connected with a line 474 which passes through a flow regulator 476 and into a second chamber 478 of the pneumatic cylinder 174. At the same time, line 468 and thus first chamber 472 of pneumatic cylinder 174 are drained through valve 454. Thus, the movable piston 175 is retracted, and the kicker 170 is moved downwardly. The downward movement of the kicker folds the upper trailing minor flap of a box driven through the machine 10. As can be seen in FIG. 10, when the box depresses the cam 84, the kicker will fold the upper trailing minor flap of the box. Accordingly, the position of the cam 94 must be specifically set so that the kicker 170 is activated at the correct time. Such adjustment will be further described below.

The circuit remains as illustrated in FIG. 11C until the first cam mechanism 56 returns to its raised biased position. Such occurs when the box leaves cam portions 62. The release of the second cam mechanism 58 does not affect the circuit except that the second three-way two position valve 94 will assume its biased position. It does not matter whether the second cam mechanism 58 is released before or after the first cam mechanism 56 since the one shot valve 460 isolates the valve 94 from the valve 454 after the single measure pulse until one shot valve 460 is reset. When the first cam mechanism 56 is released, the first three-way two position valve 78 will move to its bias position. Thus, line 420 and line 456 will be disconnected by valve 78. As a result, valve 436 will assume its bias position, as shown in FIG. 11A, the movable piston 120 and gate 116 will be retracted, and control pressure will be applied through line 452 against valve 454 once again shifting it to the right, as shown in FIG. 11A. Since air pressure through the second three-way two position valve goes through the one shot valve 460, line 462 is unpressurized no matter whether valve 94 has been released yet or not. Thus, valve 454 can shift even when air pressure is continued to be supplied through valve 94. When the second cam mechanism 58 is released, valve 94 disconnects line 458 from line 422 and the one shot valve 460 is reset. The machine 10 is now ready for the next box which has begun its travel through the machine 10 as soon as the first cam mechanism 56 is released. Moreover, the kicker will be activated at precisely the same location for each box in accordance with its adjusted position.

Referring again to FIG. 5, the adjustments of the first and second cam mechanisms 56 and 58, and the effect of such adjustment will be described. As apparent from the description above, the first cam mechanism 56 including first and second cam portions 60 and 62 is responsible for raising and lowering the gate 116, and setting the kicker circuit and raising the kicker 170. The gate 116 is raised and the kicker circuit is readied as soon as the first cam portion 60 is depressed by a box driven through the machine 10. When the box leaves the first cam mechanism 56 such that it assumes its upwardly biased position, the gate 116 is lowered and the kicker 170 is raised so long as the kicker has been activated by the second cam mechanism 58 during the time which cam mechanism 56 is depressed. Activation of the second cam mechanism 58 by depression of cam 84 activates the kicker 170 to its lowered position which folds the upper trailing minor box flap. If the second cam mechanism 58 is depressed after the first cam mechanism 56 has been released, the kicker 170 will not operate because the cam mechanisms 56 and 58 are incorrectly set for the particular box being run. However, because of the unique long cam design of the present invention, such adjustment can be easily made. It is clear that the spacing between boxes depends on the length of the cam portions 60 and 62, and that the kicker 170 is actuated to fold the upper trailing minor box flap when cam 84 is depressed. More specifically, as seen in FIG. 7, the spacing between boxes is determined by the combined length of cam portions 60 and 62 and the distance between cam portion 60 and the gate 116. In other words, the spacing is determined by the distance between the trailing edge of cam portion 62 and the gate 116. The length of the first cam portion 60 of the cam mechanism 56 is also related to the distance between the rollers of the taping heads, which is noted in FIG. 3 as distance T. Distance T is the minimum spacing permitted between boxes such that the taping heads can operate properly, and the length of cam portion 60 is preferably equal to or greater than such distance T. Thus, if it is desired to increase the rate at which boxes are driven through the machine 10, the second cam portion 62 can be removed. If cam 62 is removed, the box spacing is the distance between the trailing edge of cam portion 60 and the gate 116. However, cam portion 62 can only be removed if the boxes exceed a minimum value. The minimum value depends on the distance between the trailing edge of the first cam portion 60 and the leading edge of the ski 164. If the size of the trailing minor flap is shorter than the distance between the leading edge of the ski 164 and the trailing edge of the cam portion 60, the kicker 170 will be released before the ski 164 has a chance to hold the flap down. With standard size boxes being driven through a preferred embodiment of the subject box closing and sealing machine 10, boxes below 12 inches were determined to be too short to run with only cam portion 60. It is contemplated to include interchangeable cam portions 60 and/or 62 or adjustable length cams so that many different spacings can be accommodated for boxes run through the machine at many different rates.

It is further understood that many other modifications could be made to the subject box closing and sealing machine and be within the scope of the present invention. In this regard, it is contemplated that many other electrical circuits and pneumatic circuits could be utilized. Moreover, other types of control systems, including mechanical, electronic and hydraulic systems and combinations thereof are possible and can be activated by the cam arrangement of the present invention.

We claim:

1. An apparatus for applying tape to an article comprising:

a base including a surface over which the article can be conveyed in a longitudinal direction of said apparatus and means for supporting said surface in position;

an upper taping head assembly including an upper taping head for applying tape to the article as the article is conveyed past said upper taping head in the longitudinal direction of said apparatus; and upper taping head support means for supporting said upper taping head assembly in a position over said surface, said upper taping head support means comprising an upper case beam, means for operatively supporting said upper cross beam with respect to said base, a lower cross beam below said upper cross beam, and means for operatively supporting said lower cross beam with respect to said base, said lower cross beam defining a transverse axis generally perpendicular to the longitudinal direction of the apparatus, said upper cross beam being adjustably connected with said upper taping head assembly so that said upper taping head assembly can be angularly adjusted about said transverse axis.

2. The apparatus of claim 1, wherein said upper taping head support means further comprises a strut connected between said base and said upper cross beam for operatively supporting said upper cross beam relative to said base, and said lower cross beam is pivotally connected to said strut about said transverse axis and is connected with said upper taping head.

3. The apparatus of claim 2, wherein said strut is adjustable in length so that said upper cross beam is adjustable relative to said base, said strut comprises a fixed lower strut and a movable upper strut, and said lower cross beam is pivotally connected to said upper movable strut.

4. The apparatus of claim 2, wherein said upper taping head assembly further includes a box flap folding means for folding at least one upper flap of a box as the box is conveyed through said apparatus, said box flap folding means comprising a support member that is connected with said lower cross beam so that said support member is adjustable therewith.

5. The apparatus of claim 4, wherein said support member is further adjustably connected to said upper cross beam for fixing said upper taping head assembly in a plurality of adjusted positions about said transverse axis.

6. The apparatus of claim 5, wherein the adjustable connection between said support member and the upper cross beam comprises a plate portion of said upper cross beam and a plate portion of said support member which are adjustably connected together by a means for permitting increasing and decreasing of the distance between the plate portions of said upper cross beam and said support member to thereby rotate the lower cross beam about its pivotal axis.

7. The apparatus of claim 6, wherein said box flap folding means further comprises a ski connected with said support member for engaging with at least one flap of a box conveyed through said apparatus, said ski being vertically adjustable by said adjustable strut and being adjustable about said transverse axis with said support member and said lower cross beam.

8. The apparatus of claim 7, wherein said box flap folding means further comprises a kicker which is pivotally mounted to said support member and which is movable between plural angular positions by a drive means, said kicker being vertically adjustable by said adjustable strut and being adjustable about said transverse axis with said support member and said lower cross beam.

9. The apparatus of claim 8, further including a control means for activating said drive means so as to selectively position said kicker in any one of its plural positions, said control means including a cam means supported by said base along said surface thereof for determining the position of said kicker depending on the position of a box being conveyed through said apparatus.

10. The apparatus of claim 9, further including a conveying means for driving a box through said apparatus and a gating mechanism for controllably permitting boxes to be fed to said apparatus, wherein said gating mechanism includes a gate movable between a blocking position and a passing position by a second drive means also under the control of said cam means of said control means.

11. The apparatus of claim 10, wherein said cam means comprises a first cam mechanism and a second cam mechanism, said first cam mechanism includes a leading edge which is closer to said gate than leading edge of said second cam mechanism, both of which are independently movable between raised positions where portions thereof are above the surface of said base and lower positions where they lie below the surface of said base, said first and second cam mechanisms include means for biasing them to their raised positions, and said first and second cam mechanisms control said drive means for said kicker and said second drive means for said gate so that when both cam mechanisms are in their raised positions, the kicker is in a raised position permitting a box to travel thereunder and the gate is in its passing position permitting a box to travel thereover, when said first cam mechanism is depressed to its lower position by a box, said gate is driven by said second drive means to its blocking position for preventing the infeed of another box, and when said second cam mechanism is depressed to its lower position by the box while the first cam mechanism is maintained depressed, said kicker is activated to move to a lower position for folding an upper flap of the box conveyed through said apparatus.

12. The apparatus of claim 11, wherein said first cam mechanism is of a sufficient length in the direction of travel of the box through said apparatus so that release of the first cam mechanism occurs after said second cam mechanism is depressed, and the release of said first cam mechanism causes said drive means of said kicker to move said kicker to its raised position and said second drive means to lower said gate to its passing position.

13. The apparatus of claim 12, wherein said second cam mechanism in adjustably mounted to said base to be selectively positionable within a range in the direction of travel of the box through said apparatus.

14. The apparatus of claim 13, wherein said first cam mechanism comprises a plurality of cam portions, at least one of which is removable.

15. The apparatus of claim 12, wherein said control means comprises a pneumatic circuit, said first and second cam mechanisms each include a control valve actuable between plural positions depending on whether the cam mechanisms are raised or lowered, and said drive means for said kicker and said second drive means for said gate comprise pneumatic cylinders.

16. An apparatus for conveying and closing a box comprising:

a base including a surface over which the box can be conveyed and means for supporting said surface in position;

a box flap folding means comprising a kicker which is pivotally mounted to a support member and a drive means for selectively moving said kicker between plural angular positions;

upper support means for supporting said support member and said kicker in a position over said surface so that a flap of a box moved in one direction along said surface of said base can be folded by said kicker;

conveying means for moving a box along said surface in the one direction from an infeed end to an exit end of said apparatus;

a gating mechanism movable between a blocking position and a passing position for selectively blocking or allowing a box to enter the infeed end of said apparatus;

a control system for selectively controlling said drive means for said kicker and said gating mechanism, said control system comprising a first cam mechanism and a second cam mechanism with a leading edge of said first cam mechanism located closer to said infeed end than a leading edge of said second cam mechanism, said first and second cam mechanisms being independently movable between raised positions where portions thereof are above the surface of said base and lower positions where they lie below the surface of said base, said first and second cam mechanisms are biased to their raised positions so that they will be forced toward their lower positions by engagement thereof with a box being conveyed through said apparatus, said control system further comprising a control means for operatively connecting said first and second cam mechanisms, said drive means of said kicker and said gating mechanism so that when both cam mechanisms are in their raised positions, the kicker is in a raised position permitting a box to travel thereunder and the gating mechanism is in its passing position permitting a box to travel thereover, when said first cam mechanism is depressed to its lower position by a box, said gating mechanism is moved to it blocking position for preventing the infeed of another box, when said second cam mechanism is depressed to its lower position by the box while the first cam mechanism is maintained depressed by the box, said kicker is activated to move to a lower position for folding an upper flap of the box conveyed through said apparatus, and when said first cam mechanism is released to its raised position after the kicker has ben moved to its lower position, said kicker is activated to move to its raised position.

17. The apparatus of claim 16, wherein said gating mechanism comprises a gate movably mounted to said base and a second drive means for moving said gate between blocking and passing positions.

18. The apparatus of claim 17, wherein said first cam mechanism is of a sufficient length in the direction of travel of the box through said apparatus so that release of the first cam mechanism occurs after said second cam mechanism is depressed, and the release of said first cam mechanism causes said drive means of said kicker to move said kicker to its raised position and said second drive means to lower said gate to its passing position.

19. The apparatus of claim 18, wherein said second cam mechanism in adjustably mounted to said base to be selectively positionable within a range in the direction of travel of the box through said apparatus.

20. The apparatus of claim 19, wherein said first cam mechanism comprises a plurality of cam portions, at least one of which is removable.

21. The apparatus of claim 17, wherein said control means comprises a pneumatic circuit, said first and second cam mechanisms each include a control valve actuable between plural positions depending on whether the cam mechanisms are raised or lowered, and said drive means for said kicker and said second drive means for said gate comprise pneumatic cylinders.

22. An apparatus for applying tape to an article comprising:

a base including a surface over which the article can be conveyed and means for supporting said surface in position;

a upper taping head assembly including an upper taping head for applying tape to the article as the article is conveyed past said upper taping head in one direction of said apparatus;

upper taping head support means for supporting said upper taping head assembly in a position over said surface;

conveying means for moving a box along said surface in the one direction from an infeed end to an exit end of said apparatus;

a gating mechanism movable between a blocking position and a passing position for selectively blocking or allowing a box to enter the infeed end of said apparatus;

a control system for selectively controlling said gating mechanism, said control system comprising a first cam mechanism, said first cam mechanism being movable between a raised position where a portion thereof is above the surface of said base and a lower position where it lies below the surface of said base, said first cam mechanism being biased to its raised position so that it will be forced toward its lower position by engagement thereof with a box being conveyed through said apparatus, said control system further comprising a control means for operatively connecting said first cam mechanism and said gating mechanism so that when said first cam mechanism is in its raised position, the gating mechanism is in its passing position permitting a box to enter said apparatus, when said first cam mechanism is depressed to its lower position by a box, said gating mechanism is moved to its blocking position for preventing the infeed of another box, when the first cam mechanism is released, said gating mechanism is moved to its passing positions, and said the first cam mechanism includes a cam portion that extends sufficiently long in the direction of travel of a box through said apparatus so as to significantly increase the spacing between boxes conveyed through said apparatus to be greater than the spacing between the gating mechanism and a leading edge of the cam portion.

23. The apparatus of claim 22, wherein said gating mechanism comprises a gate movably mounted to said base and a first drive means for moving said gate between blocking and passing positions.

24. The apparatus of claim 23, further including a box flap folding means comprising a kicker which is pivotally mounted to a support member and a second drive means for selectively moving said kicker between plural angular positions, and upper support means for supporting said support member and said kicker in a position over said surface so that a flap of a box moved in the one direction along said surface of said base can be folded by said kicker.

25. The apparatus of claim 24, wherein said control system further includes a second cam mechanism, said first cam mechanism having a leading edge closer to the infeed end of said apparatus than a leading edge of said second cam mechanism, said second cam mechanism is movable between a biased raised position with a portion thereof above the surface of said base and a lower position below the surface of said base, and when said second cam mechanism is depressed, said second drive means for moving said kicker is activated to move said kicker from a raised position to a lower position for folding a flap of a box conveyed through said apparatus.

26. The apparatus of claim 25, wherein said first cam mechanism is of sufficient length in the direction of travel of the box through said apparatus so that release of the first cam mechanism occurs after said second cam mechanism is depressed, and the release of said first cam mechanism causes said second drive means of said kicker to move said kicker to its raised position.

27. The apparatus of claim 26, wherein said second cam mechanism is adjustable mounted to said base to be selectively positionable within a range in the direction of travel of the box through said apparatus.

28. The apparatus of claim 27, wherein said first cam mechanism comprises a plurality of cam portions, at least one of which is removable.

29. The apparatus of claim 25, wherein said control means comprises a pneumatic circuit, said first and second cam mechanisms each include a control valve actuable between plural positions depending on whether the cam mechanisms are raised or lowered, and said second drive means for said kicker and said first drive means for said gate comprise pneumatic cylinders.

30. An apparatus for conveying and closing a box comprising:

a base including a surface over which the box can be conveyed and means for supporting said surface in position;

a box flap folding means comprising a kicker which is pivotally mounted to a support member and a drive means for selectively moving said kicker between plural angular positions;

upper support means for supporting said support member and said kicker in a position over said surface so that a flap of a box moved in one direction along said surface of said base can be folded by said kicker;

conveying means for moving a box along said surface in the one direction from an infeed end to an exit end of said apparatus;

a gating mechanism movable between a blocking position and a passing position for selectively blocking or allowing a box to enter the infeed end of said apparatus;

control means for selectively controlling said drive means for said kicker and said gating mechanism, said control means comprising a pneumatic circuit including first and second vales, each valve having a first and a second position and a bias means urging the valve to its first position, and actuation means for independently moving said first and second valves to their second positions in accordance with the position of a box being conveyed through said apparatus, said pneumatic circuit also being operatively connected with said drive means for said kicker and said gating mechanism so that when both valves are in their biased first positions, the kicker is in a raised position permitting a box to travel thereunder and the gating mechanism is in its passing position permitting a box to travel thereover, when said first valve is moved to its second position by said actuation means, said gating mechanism is moved to its blocking position for preventing the infeed of another box, when said second valve is moved to its second position by said actuation means while the first valve is maintained in its second position, said kicker is activated to move to a lower position for folding an upper flap of the box conveyed through said apparatus, and when said first valve is returned to its first position by said actuation means after said kicker is lowered, said kicker is activated to move to its raised position.

31. The apparatus of claim 30, wherein when said first valve is returned to its first position by said actuation means, said kicker is moved by its drive means to its raised position and said gating mechanism is lowered to its passing position.

32. The apparatus of claim 31, wherein said actuation means comprises a first cam mechanism and a second cam mechanism with a leading edge of said first cam mechanism located closer to said infeed end than the leading edge of said second cam mechanism, said first and second cam mechanisms being independently movable between raised positions where portions thereof are above the surface of said base and lower positions where they lie below the surface of said base, said first and second mechanisms are biased to their raised positions so that they will be forced toward their lower positions by engagement thereof with a box being conveyed through said apparatus, said first cam mechanism actuates said first valve to move said first valve from its first to its second position when said first cam mechanism is depressed, and said second cam mechanism actuates said second valve to move said second valve from its first to its second position when said second cam mechanism is depressed.

* * * * *

UNITED STATES PATENT AND TRADEMARK OFFICE

CERTIFICATE OF CORRECTION

PATENT NO. : 5,323,586

DATED : June 28, 1994

INVENTOR(S) : Vasilakes et al.

It is certified that error appears in the above-indentified patent and that said Letters Patent is hereby corrected as shown below:

Col. 5, line 20, "Fig. 13" should read --Figure 13 illustrating the--.

Col. 19, line 65, "case" should read --cross--.

Col. 21, line 9, "than leading" should read --than a leading--.

Col. 23, line 8, "a upper" should read --an upper--.

Col. 23, line 43, "said the first" should read --said first--.

Signed and Sealed this

Ninth Day of April, 1996

Bruce Lehman

*Attest:*

BRUCE LEHMAN

*Attesting Officer*

*Commissioner of Patents and Trademarks*